US011506440B2

(12) United States Patent
Chuang et al.

(10) Patent No.: US 11,506,440 B2
(45) Date of Patent: Nov. 22, 2022

(54) COOLER WITH GAME LID

(71) Applicant: TRINITY INTERNATIONAL INDUSTRIES, L.L.C., Carson, CA (US)

(72) Inventors: Yuan-Luen Chuang, Shanghai (CN); Cze-Chao Tam, Palos Verdes, CA (US)

(73) Assignee: TRINITY INTERNATIONAL INDUSTRIES, L.L.C., Carson, CA (US)

( * ) Notice: Subject to any disclaimer, the term of this patent is extended or adjusted under 35 U.S.C. 154(b) by 526 days.

(21) Appl. No.: 16/777,384

(22) Filed: Jan. 30, 2020

(65) Prior Publication Data

US 2021/0025633 A1 Jan. 28, 2021

Related U.S. Application Data

(63) Continuation of application No. 29/699,117, filed on Jul. 23, 2019, now Pat. No. Des. 912,476.

(51) Int. Cl.
*F25D 3/06* (2006.01)
*A63F 9/00* (2006.01)

(52) U.S. Cl.
CPC ..... *F25D 3/06* (2013.01); *A63F 9/001* (2013.01); *A63F 2009/0012* (2013.01); *F25D 2300/00* (2013.01); *F25D 2400/08* (2013.01)

(58) Field of Classification Search
CPC .... B65D 81/18; B65D 81/20; B65D 81/2007; B65D 81/2015; B65D 81/2023;
(Continued)

(56) References Cited

U.S. PATENT DOCUMENTS 4,889,257 A * 12/1989 Steffes ..... A45C 5/00 220/815
4,974,426 A * 12/1990 Gomez ..... A45C 11/20 62/464

(Continued)

FOREIGN PATENT DOCUMENTS

CN 202784295 U 3/2013

OTHER PUBLICATIONS

International Search Report dated Apr. 9, 2020 from PCT Application No. PCT/US2020/015902.

*Primary Examiner* — Kareen K Thomas
(74) *Attorney, Agent, or Firm* — Innovation Capital Law Group, LLP; Vic Lin

(57) ABSTRACT

A cooler can include a game table formed in a top surface thereof. The game table can include a game surface surrounded by side walls about its perimeter for storage of the game elements and to prevent game elements, such as game balls, from escaping from the recessed game surface. The game surface can include elements for various games, including foosball, hockey, football, pool, craps, roulette, chess, checkers, backgammon or the like. In some embodiments, the game elements may be interchanged to provide multiple different games that can be played in the recessed gaming surface. In some embodiments, game players may be disposed on arms that extend across the game table in a manner similar to conventional foosball players. Such arms may be made removable to permit changing between game player-based games and games that can be played directly on the recessed surface.

17 Claims, 26 Drawing Sheets

(58) Field of Classification Search
CPC .... F25D 3/06; F25D 2300/00; F25D 2400/08; F25D 2400/38; A63F 9/001; A63F 2009/0012; A63F 3/00151; A63F 3/02; A63F 2003/00974; A63F 2003/00993; A63F 2009/0049; A63F 2009/0056; A63F 3/00895; A63F 7/0672; A63F 7/36; A63F 7/0632; A63F 2007/3674; A63F 7/06; A63D 15/02
See application file for complete search history.

(56) References Cited

U.S. PATENT DOCUMENTS 5,326,102 A 7/1994 Chang
D368,387 S 4/1996 Bureau
6,047,976 A * 4/2000 Wang ..... A45C 11/20 280/37
8,403,326 B1 * 3/2013 Flanagan ..... A63F 7/30 273/317.1
8,777,045 B2 * 7/2014 Mitchell ..... B65D 43/16 220/666
9,623,318 B2 4/2017 Yang et al.
9,976,789 B2 * 5/2018 Grepper ..... B01F 27/808
9,989,299 B1 6/2018 Ballard
2003/0168800 A1 9/2003 Tsai
2003/0197326 A1 * 10/2003 Makhoul ..... A63F 7/0612 273/108.54
2005/0205459 A1 * 9/2005 Mogil ..... B65D 81/3858 206/545
2007/0216101 A1 9/2007 Padilla
2007/0252328 A1 11/2007 Mendoza et al.
2012/0205865 A1 8/2012 Colombo et al.
2014/0038731 A1 * 2/2014 Manner ..... A63F 9/001 463/48
2016/0046416 A1 2/2016 Gao
2016/0135559 A1 5/2016 Scally
2016/0210815 A1 * 7/2016 Holt ..... G07F 17/3258

* cited by examiner

COOLER WITH GAME LID

CROSS-REFERENCE TO RELATED APPLICATIONS

This application claims the benefit of priority to U.S. patent application number 29/699,117, filed Jul. 23, 2019, the contents of which are herein incorporated by reference.

BACKGROUND OF THE INVENTION

1. Field of the Invention

Embodiments of the invention relate generally to recreation devices. More particularly, embodiments of the invention relate to a cooler having a game lid that can be used to play various games.

2. Description of Prior Art and Related Information

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Coolers are used for many occasions and outings, including picnics, holidays, beach visits and the like. Further, on such outings, people can often bring games to play at these occasions and outings, requiring separate elements for each game, often required to be carried separately.

In view of the foregoing, there is a need for a cooler that can include game elements to provide a single, integrated storage and entertainment solution.

SUMMARY OF THE INVENTION

Embodiments of the present invention provide a cooler comprising a cooler body; a cooler top at least partially removable from the cooler body, the cooler top covering the cooler body to create a space therein; side walls extending upward from an outer perimeter of the cooler top; and a game surface formed on top of the cooler top, the game surface being recessed and surrounded by the side walls.

Embodiments of the present invention further provide a cooler comprising a cooler body; a cooler top at least partially removable from the cooler body, the cooler top covering the cooler body to create a space therein; side walls extending upward from an outer perimeter of the cooler top; a game surface formed on top of the cooler top, the game surface being recessed and surrounded by the side walls; a plurality of tubes extending between opposite pairs of side walls; and a plurality of game players, at least one game player disposed on each of the plurality of tubes, the plurality of game players configured to cause an interaction with a game piece disposed on the game surface, wherein the plurality of tubes are movable to move the plurality of game players in a first direction, and the plurality of tubes are further movable to move the plurality of game players in a second direction, at least one of the first and second directions causing an interaction with the game piece.

Embodiments of the present invention also provide a cooler comprising a cooler body; a cooler top at least partially removable from the cooler body, the cooler top covering the cooler body to create a space therein; side walls extending upward from an outer perimeter of the cooler top; and a game surface formed on top of the cooler top, the game surface being recessed and surrounded by the side walls, wherein the game surface is selected from a board game surface, a gambling game surface and a pool table surface.

These and other features, aspects and advantages of the present invention will become better understood with reference to the following drawings, description and claims.

BRIEF DESCRIPTION OF THE DRAWINGS

Some embodiments of the present invention are illustrated as an example and are not limited by the figures of the accompanying drawings, in which like references may indicate similar elements.

Figure 1:
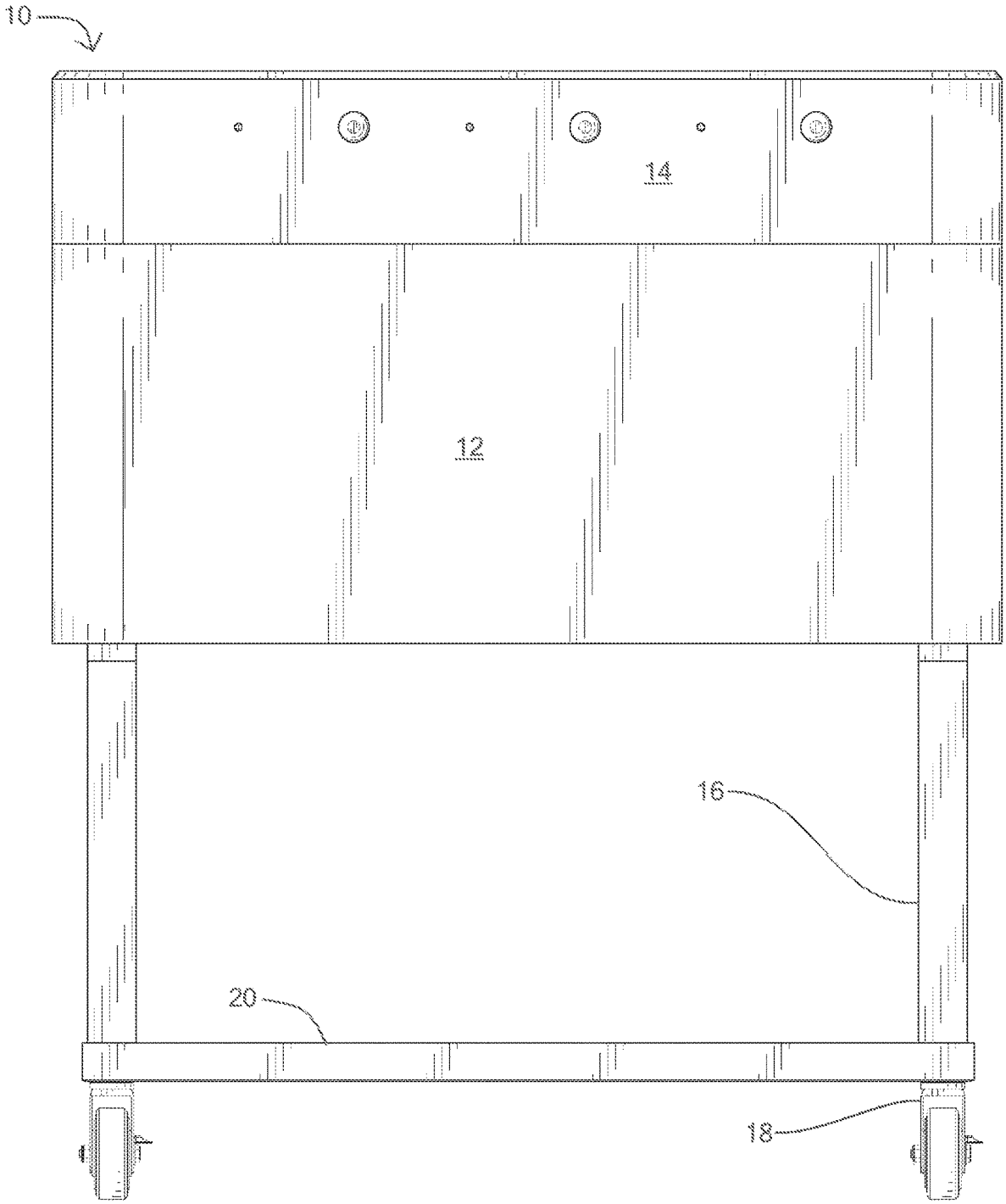
FIG. 1 illustrates front view of a cooler according to an exemplary embodiment of the present invention.
Figure 2:
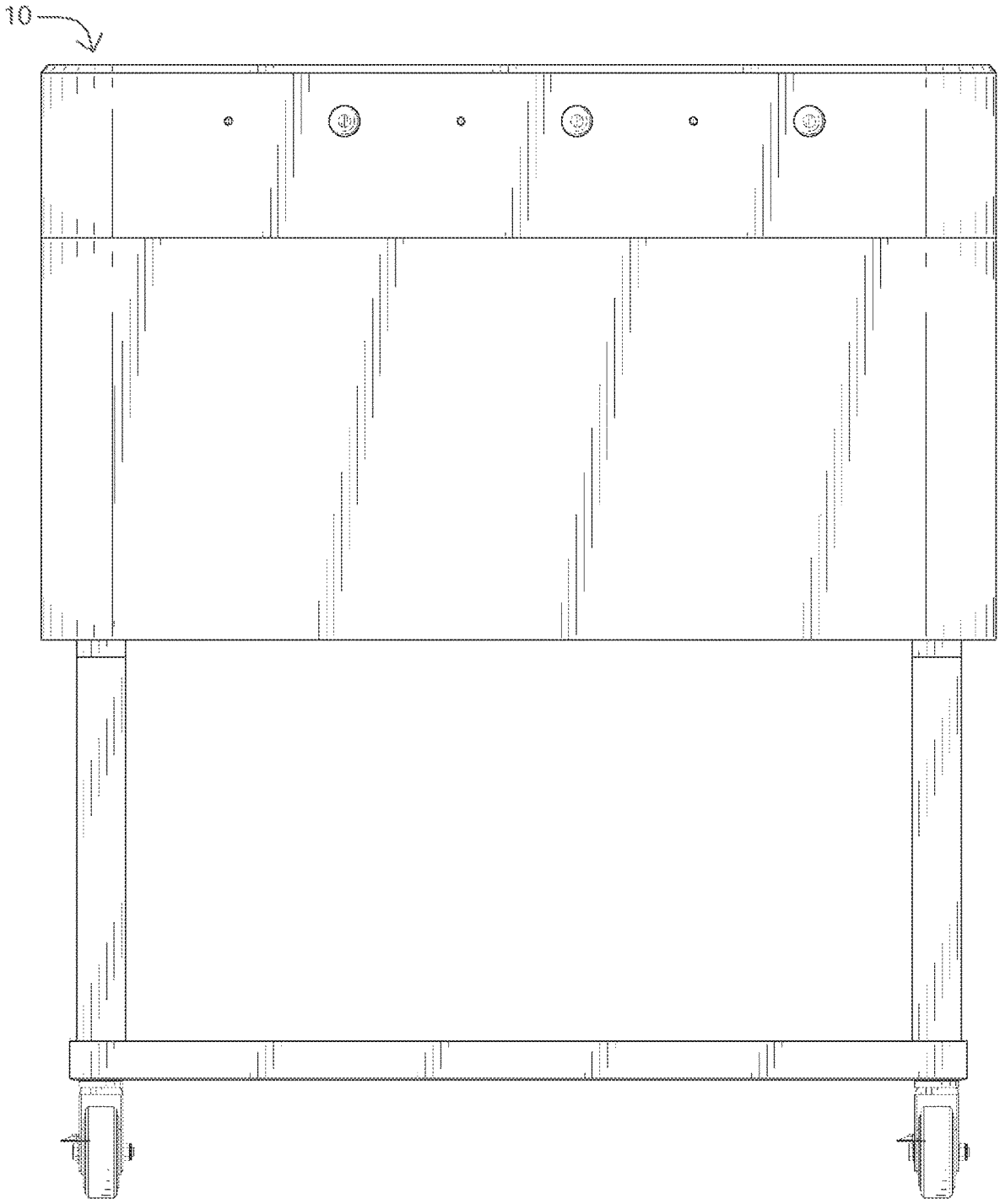
FIG. 2 illustrates back view of the cooler of FIG. 1.
Figure 3:
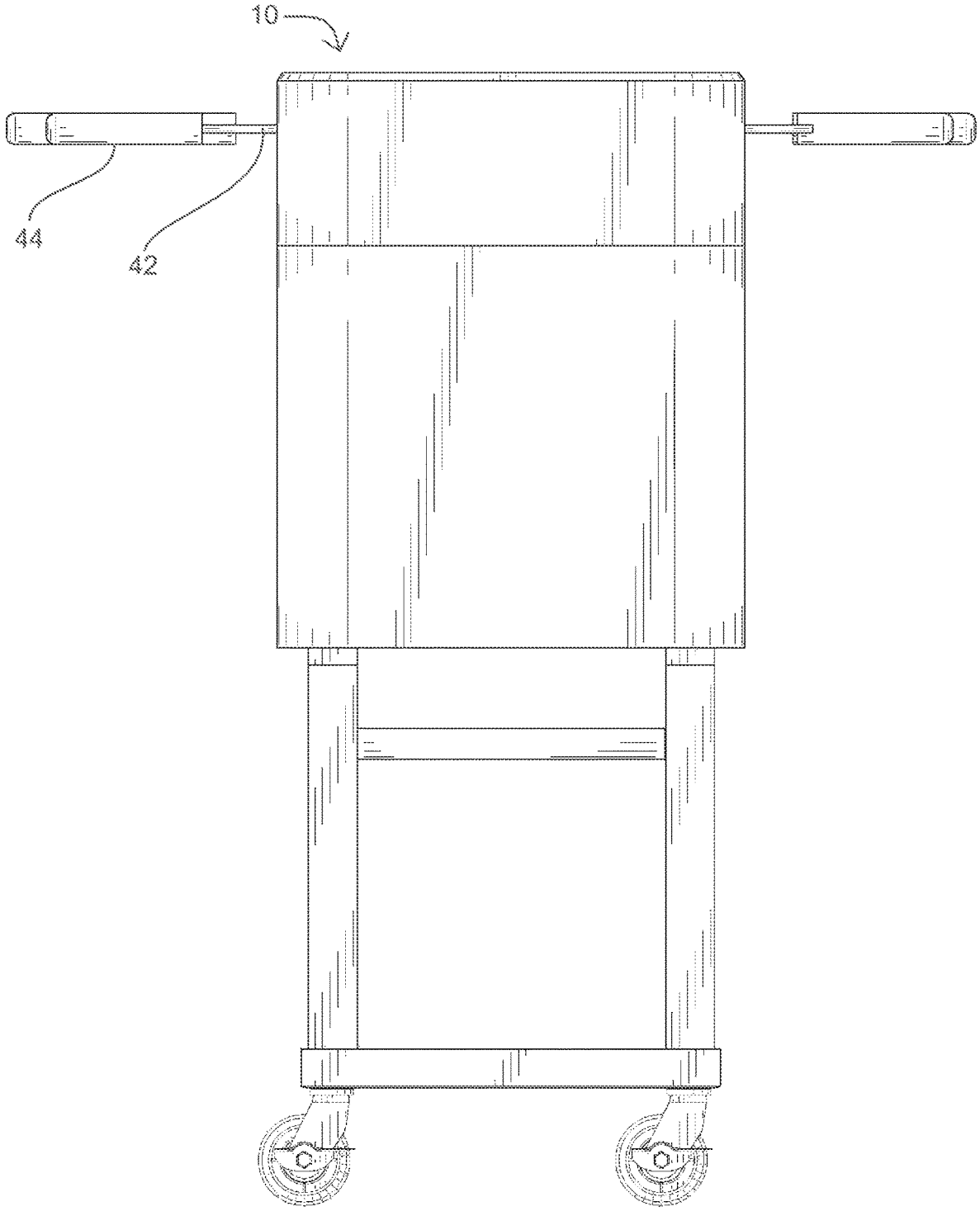
FIG. 3 illustrates left side view of the cooler of FIG. 1.
Figure 4:
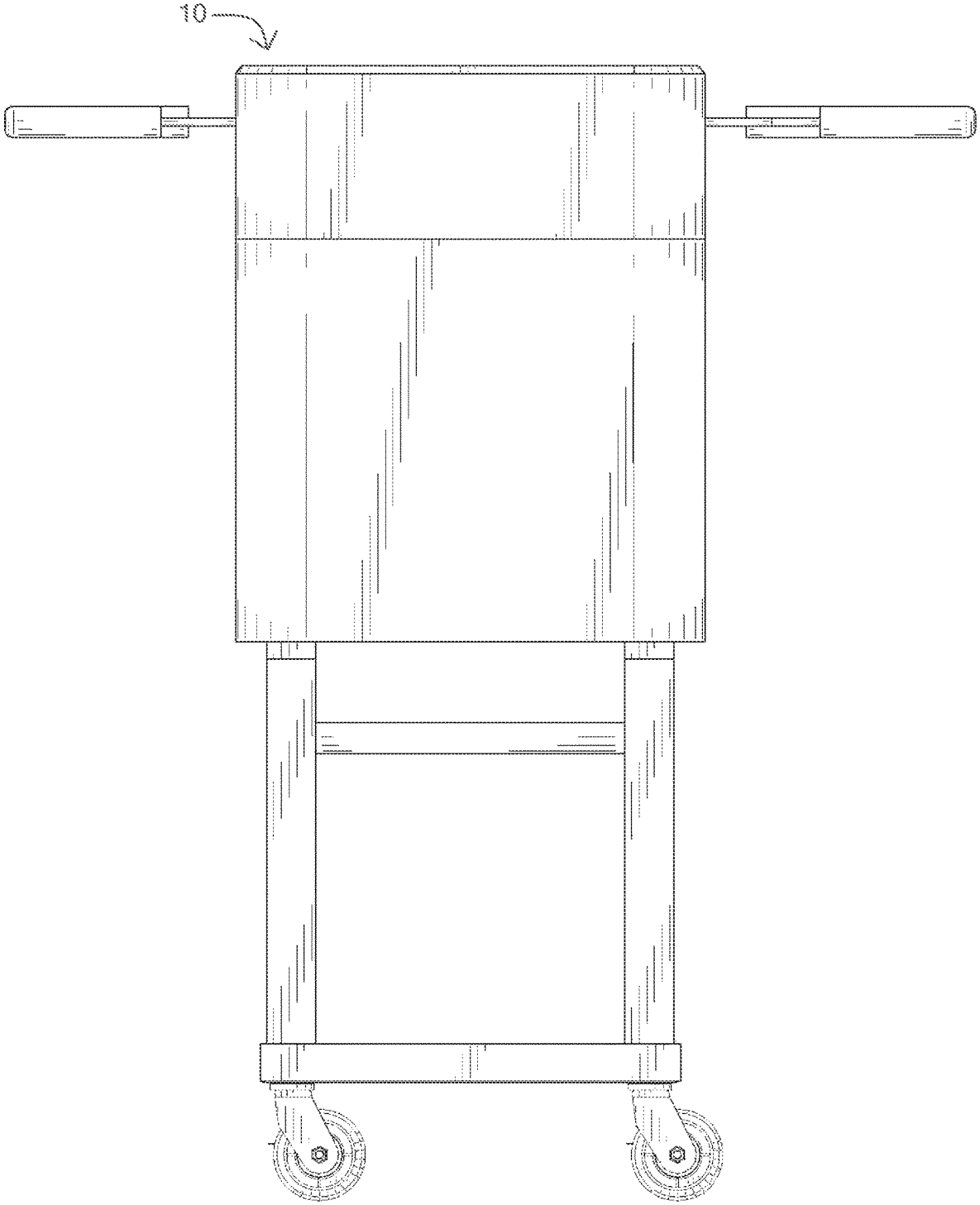
FIG. 4 illustrates right side view of the cooler of FIG. 1.
Figure 5:
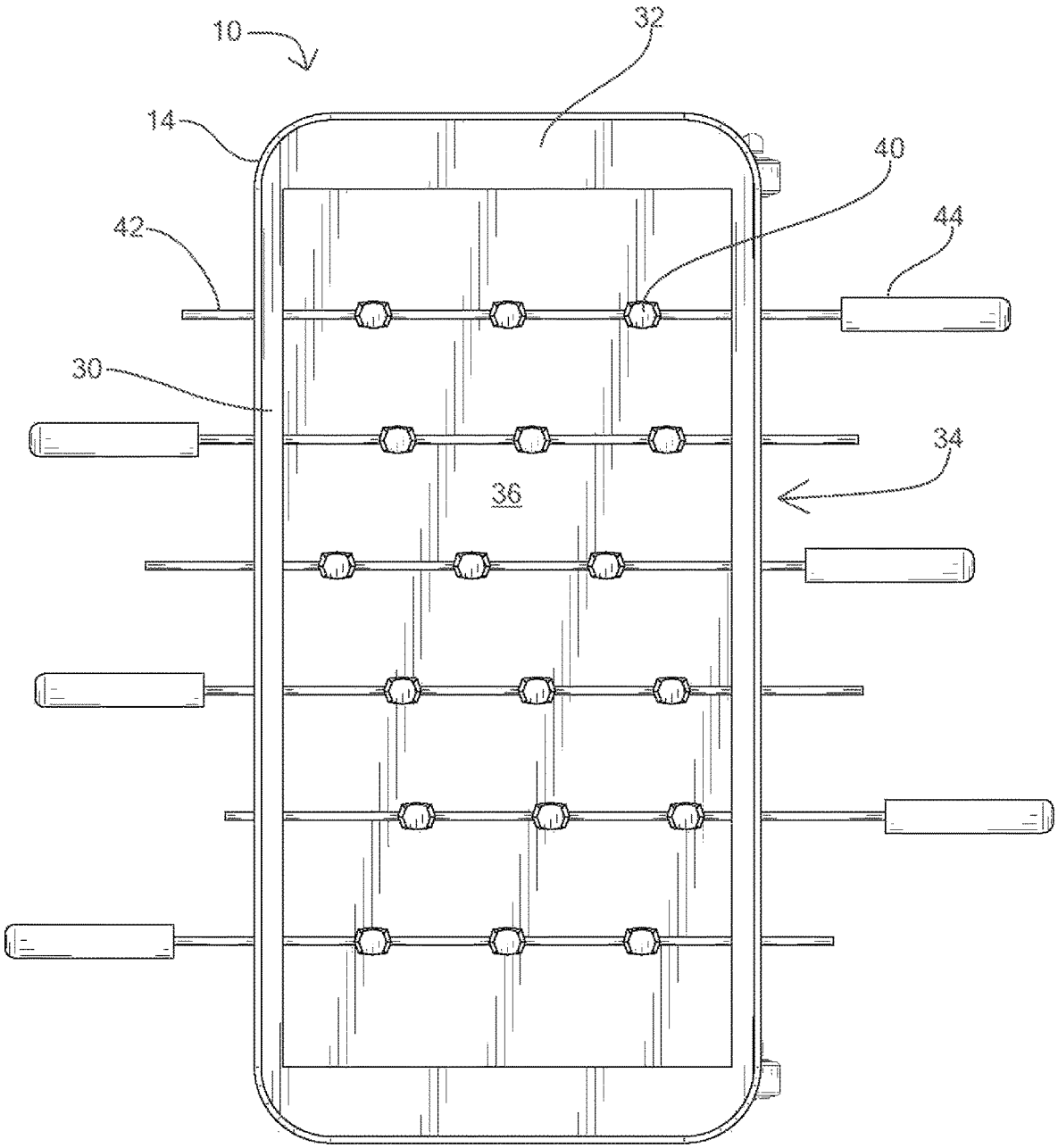
FIG. 5 illustrates top view of the cooler of FIG. 1.
Figure 6:
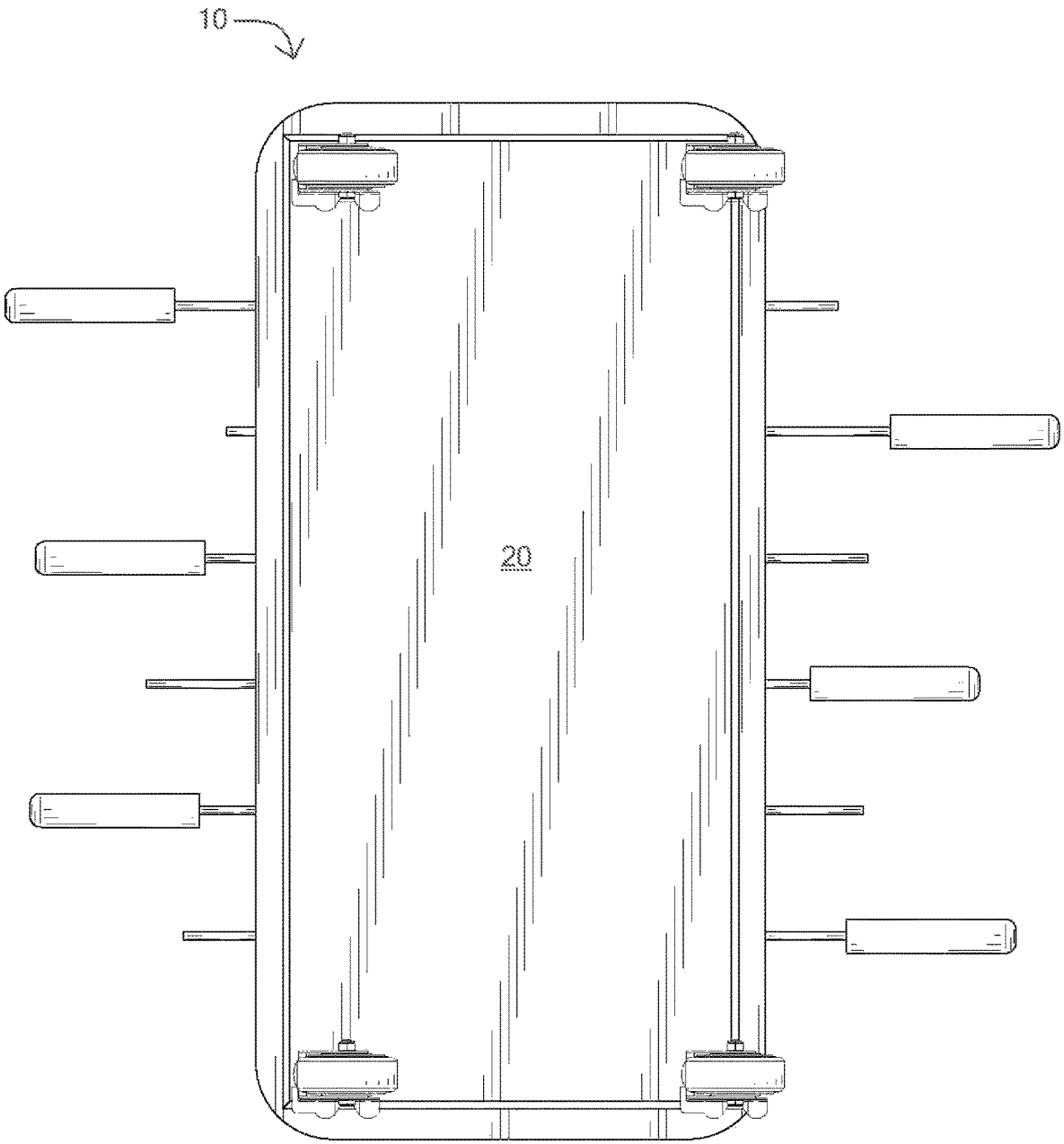
FIG. 6 illustrates bottom view of the cooler of FIG. 1.
Figure 7:
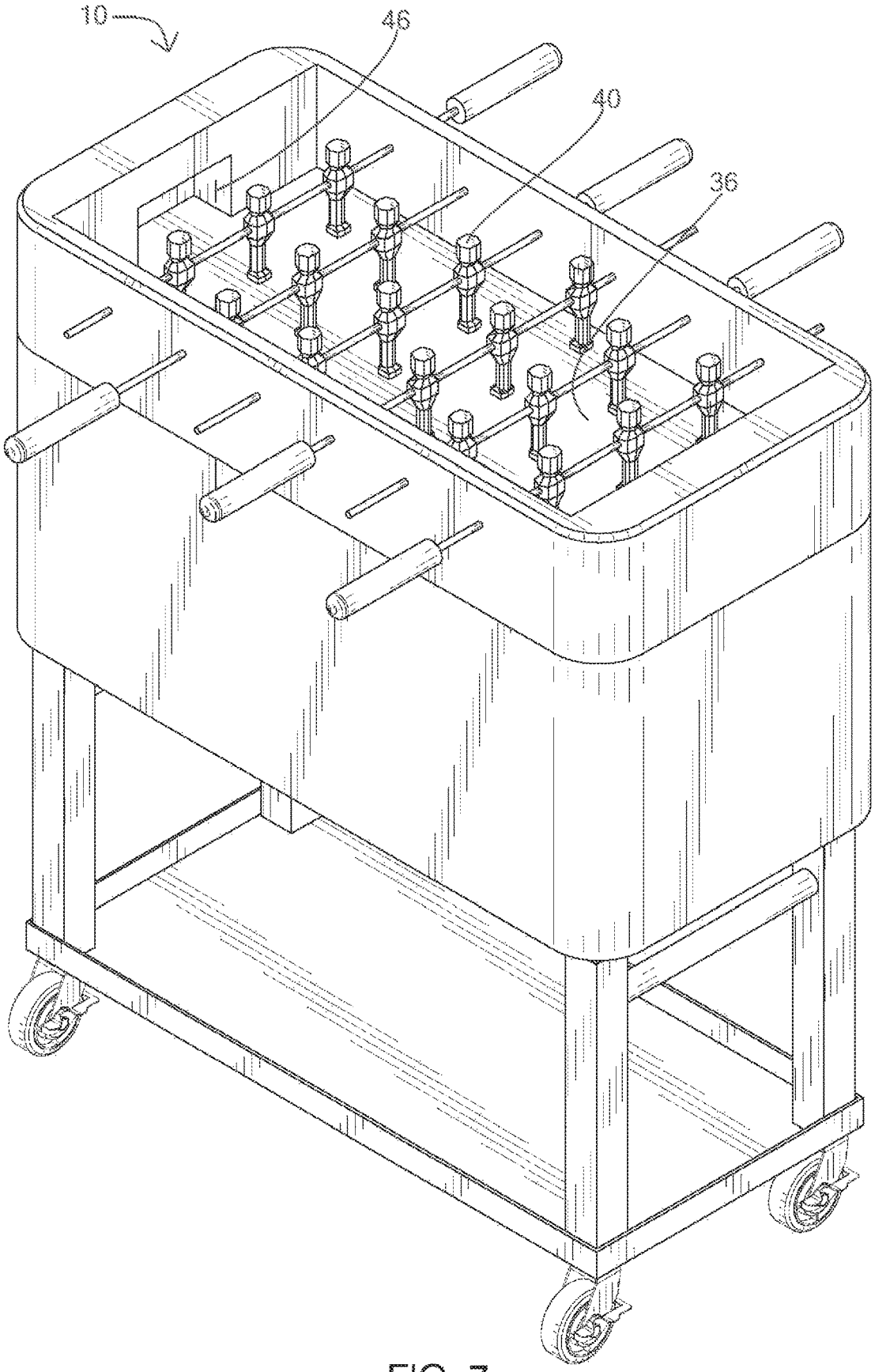
FIG. 7 illustrates front perspective view of the cooler of FIG. 1.
Figure 8:
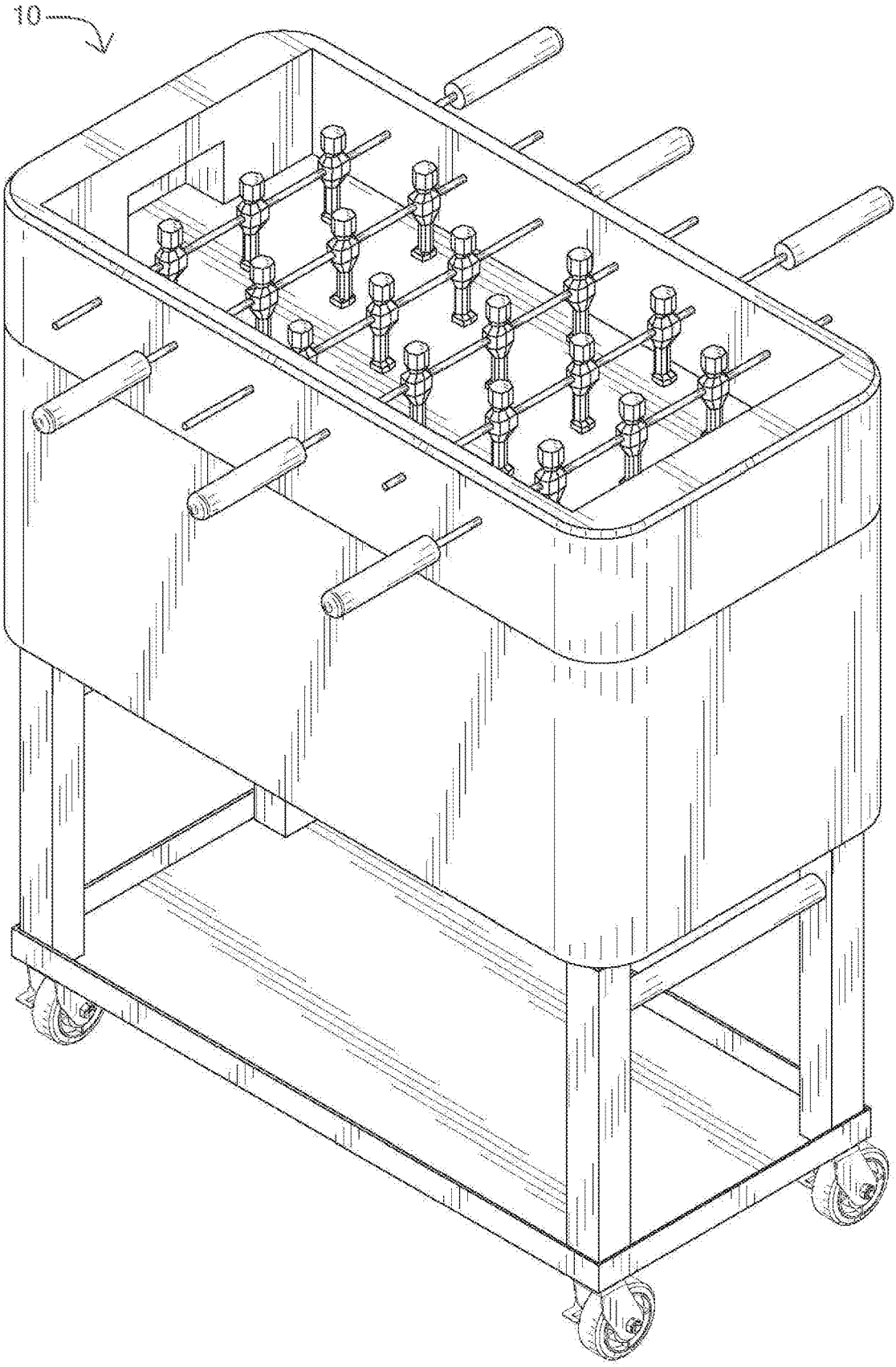
FIG. 8 illustrates back perspective view of the cooler of FIG. 1.
Figure 9:
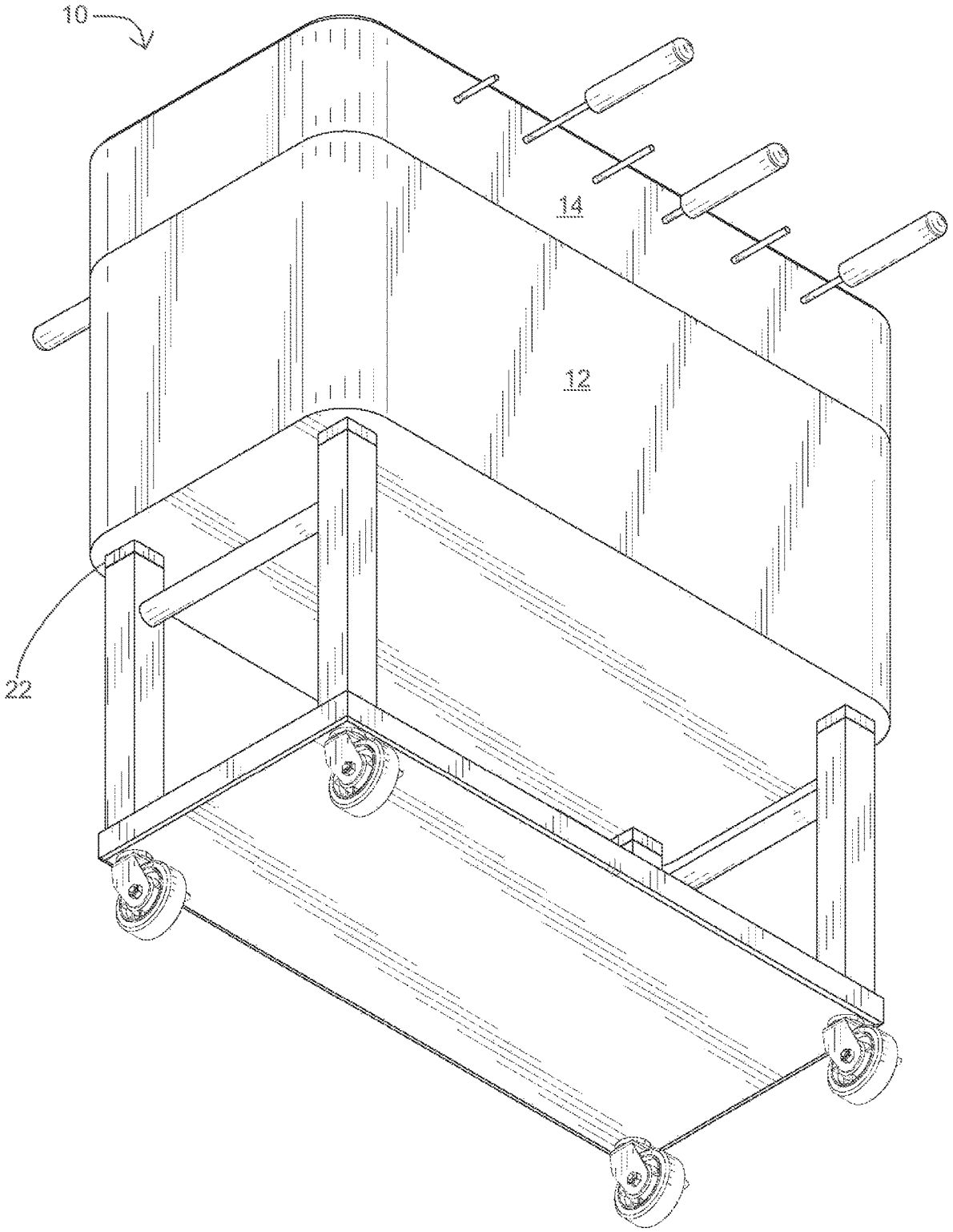
FIG. 9 illustrates bottom perspective view of the cooler of FIG. 1.

Unless otherwise indicated illustrations in the figures are not necessarily drawn to scale.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS AND BEST MODE OF INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

As is well known to those skilled in the art, many careful considerations and compromises typically must be made when designing for the optimal configuration of a commercial implementation of any device, and in particular, the embodiments of the present invention. A commercial implementation in accordance with the spirit and teachings of the present invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Broadly, embodiments of the present invention provide a cooler that can include a game table formed in a top surface thereof. The game surface can include side walls for storage of the game elements and to prevent game elements, such as game balls, from escaping from the recessed game surface. The game surface can include elements for various games, including foosball, hockey, football, pool, craps, roulette, chess, checkers, backgammon or the like. In some embodiments, the game elements may be interchanged to provide multiple different games that can be played in the recessed gaming surface. In some embodiments, game players may be disposed on arms that extend across the game table in a manner similar to conventional foosball players. Such arms may be made removable to permit changing between game player-based games and games that can be played directly on the recessed surface. A lid may be provided over the game table to prevent loss of game elements during transport.

Figure 10:
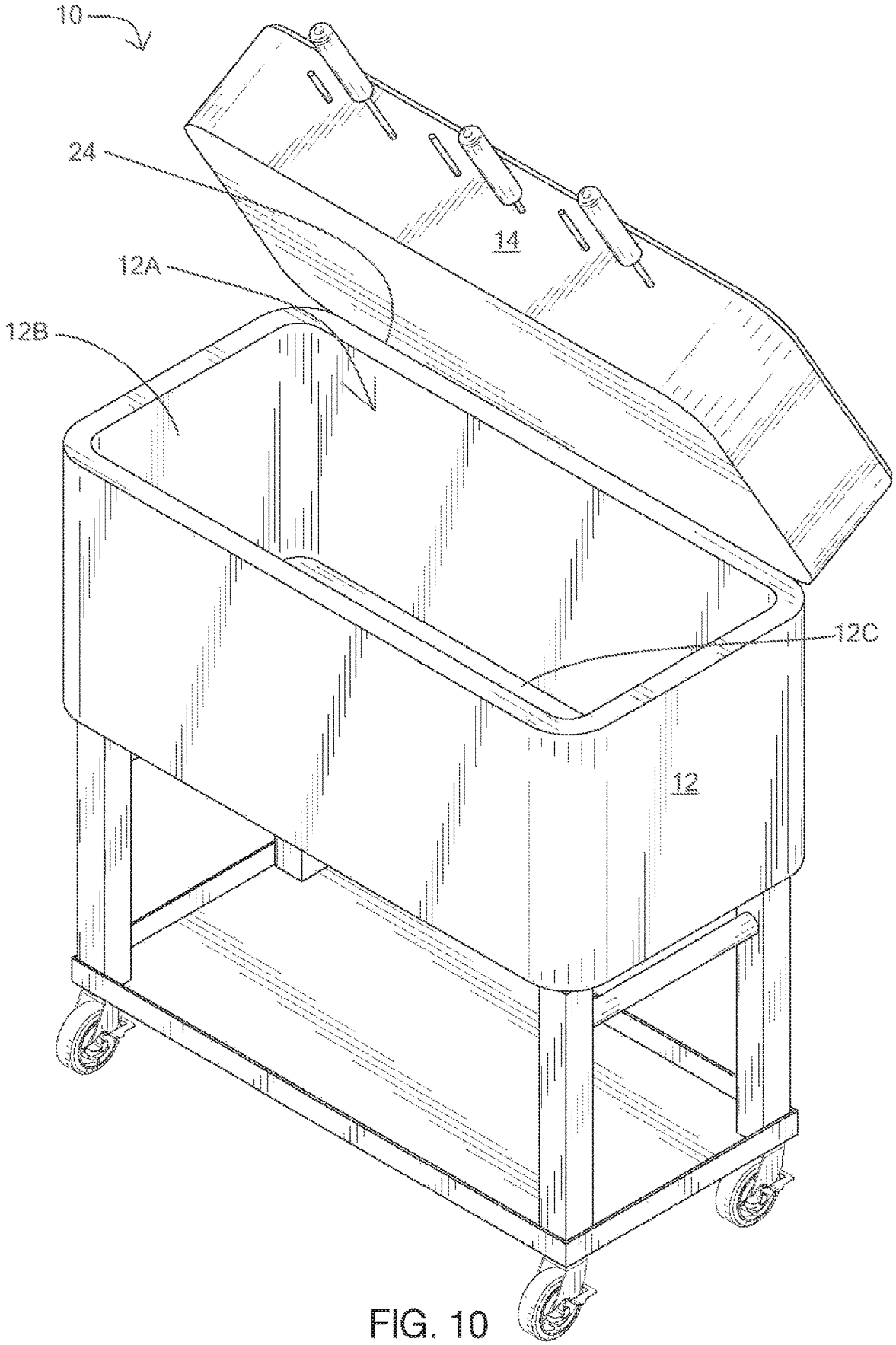
FIG. 10 illustrates front perspective view of the cooler of FIG. 1, illustrating the cooler top in an open configuration.

Referring now to FIGS. 1 through 10, a cooler and game combination device 10, also referred to as a game-cooler 10, or simply cooler 10, can include a cooler body 12 having an interior space 12A defined by insulated side walls 12B and an insulated base 12C. A cooler top 14 may fit over an open end of the cooler body 12 to enclose the interior space 12A. Typically, the cooler top 14 is at least partially insulated. A hinge area 24, as best seen in FIG. 10, may permit a hinged connection between the cooler body 12 and the cooler top 14. While the hinge area 24 is shown along a lengthwise edge of the cooler body 12 and cooler top 14, the hinge area 24 may be disposed along a widthwise edge to create a similar function for providing access to the interior space 12A of the cooler body 12.

The cooler body 12 may be disposed on a cooler stand 16. While the Figures show one particular embodiment of a cooler stand, it should be understood that the stand may take various forms as may be contemplated by one skilled in the art. Wheels 18 may be disposed on the cooler stand 16 for portability. The wheels 18 shown in the Figures may be useful on smooth or hard surfaces. The wheels 14 may be larger and/or wider, for example, for use on a sandy surface, such as a beach. The cooler stand 16 can include a lower shelf 20 positioned under the cooler body 12 when the cooler body 12 is disposed on the cooler stand 16.

A plurality of stand connectors 22 may be disposed between the cooler stand 16 and the cooler body 12. The stand connectors 22 may be useful for attaching and removing the cooler body 12 from the cooler stand 16. In some embodiments, the stand connectors 22 may create a fixed attachment between the cooler stand 16 and the cooler body 12. In other embodiments, the attachment may be a removable attachment, via various connections, such a twist lock, a pin and recess, a threaded connection, or the like.

The cooler top 14 can includes a game table 34 formed therein. The cooler top 14 can include a plurality of side walls 30 extending upward from the cooler top 14. Typically, the side walls 30 are formed integrally with the cooler top 14. However, in some embodiments, the side walls 30 may be removably attached to the cooler top 14. The side walls 30 may extend upward about an entirety of the outer perimeter of the cooler top 14, forming a recessed game area 36 therein. In some embodiments, at least two opposite ends of the side walls 30, also referred to an end walls 32, on an interior portion thereof, may be cut out to form a cut out region that may be used as a goal, a storage area, or the like, as discussed in greater detail below.

Various games can be set up on the game table 34, as discussed in greater detail below. These games may take advantage of the recessed game surface 36 so that game balls, game pieces, and the like, are not lost should the cooler 10 be moved or shifted.

In FIGS. 1 through 10, a foosball game may be configured on the game table 34. Foosball players 40 may be disposed on sliding tubes 42 having handles 44 on ends thereof. A goal 46 may be formed by a cutout on an interior of opposing widthwise end walls 32. As in a conventional foosball game, a user may twist the handles 44 to cause the foosball players 40 to rotate on an axis defined by the axis of the sliding tubes 42.

Figure 11:
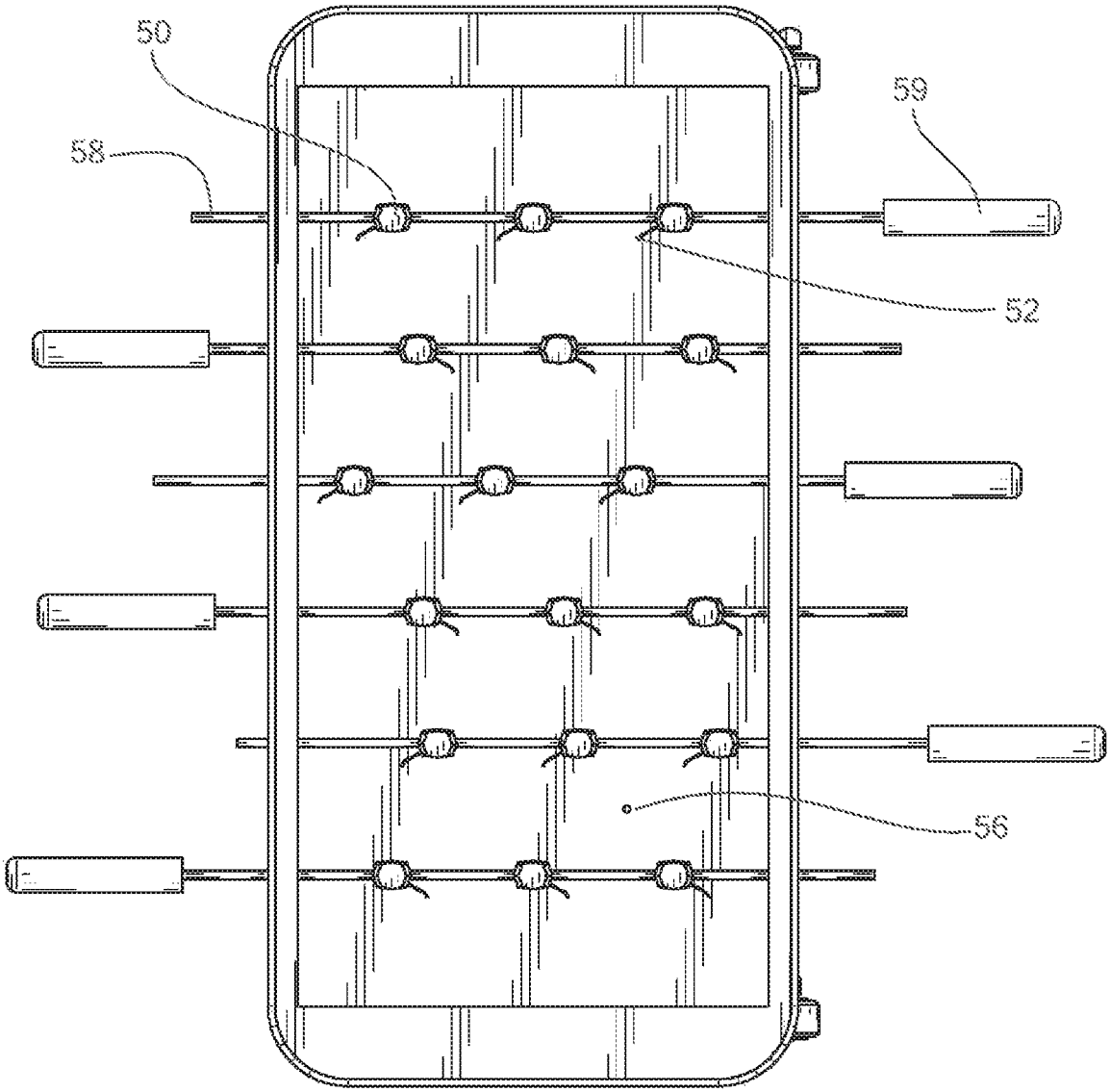
FIG. 11 illustrates top view of a cooler according to an exemplary embodiment of the present invention, including a hockey game configuration.
Figure 12:
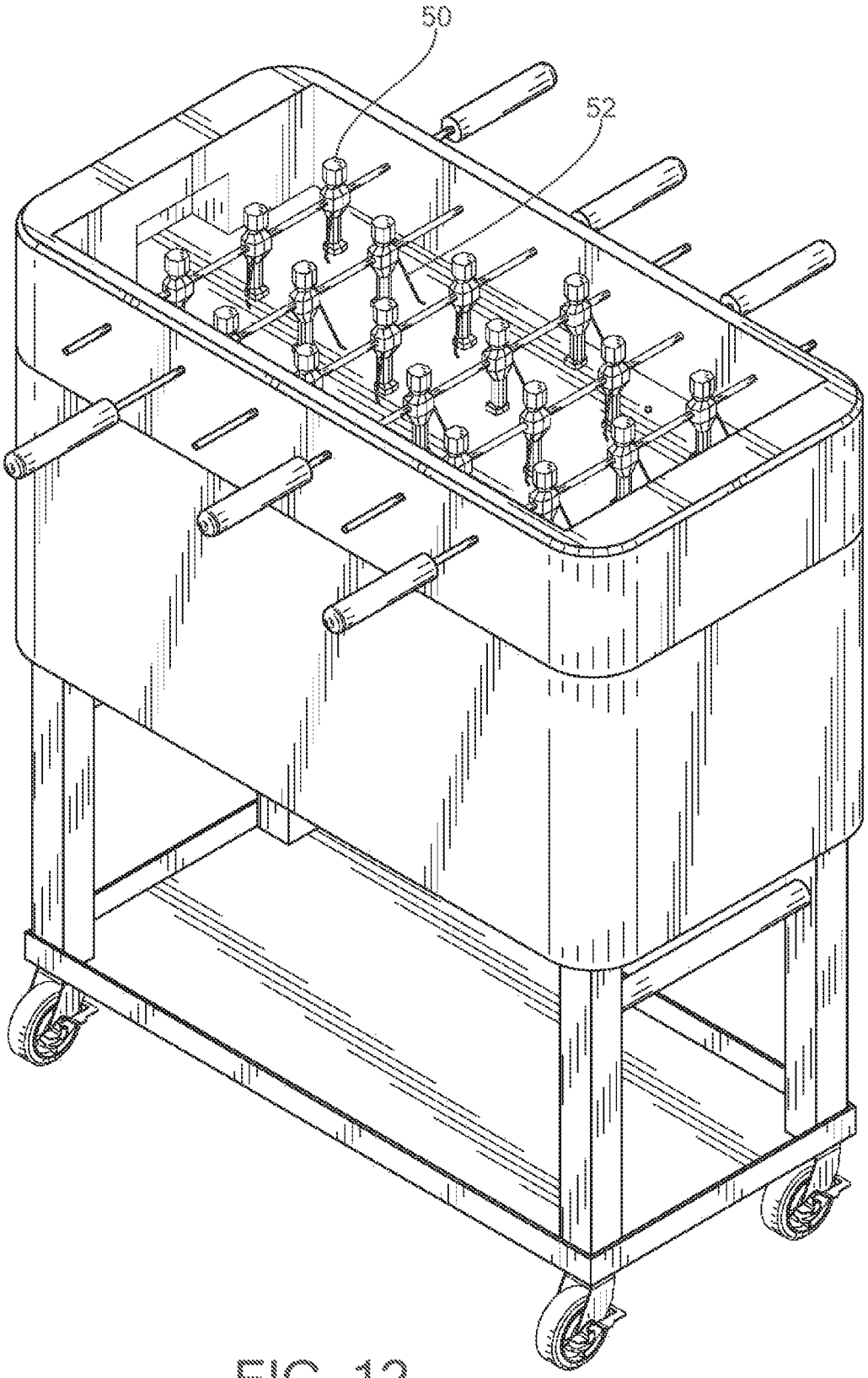
FIG. 12 illustrates perspective view of the cooler of FIG. 11.

In FIGS. 11 and 12, the game table 34 may be configured into a hockey game. In this embodiment, the foosball players may be replaced by hockey players 50, each having a hockey stick 52. A hockey puck 56 may be slid along the game surface 36. In some embodiments, a space 54 may be formed between the ends of the hockey players 50 and the game surface 36, where the space 54 may be sized to permit the hockey puck 56 to slide thereunder. In this embodiment, only the hockey sticks 52 may be used to move the hockey puck 56 on the game surface 36.

In some embodiments, the hockey players 50 may be attached to moving tubes 58 having handles 59 on ends thereof, similar in appearance to the foosball configuration discussed above. However, in some embodiments, twisting the handles 59 may cause the hockey players 50 to rotate along a longitudinal axis of the players themselves, rather than the axis of the tubes, as is the case with the foosball configuration. In other words, turning the handles may cause the hockey sticks 52 to move adjacent to the game surface 36, with the player 50 rotating along a player axis defined as extending from head to foot of the player. Appropriate gearing may be used to create such rotational movement, as may be contemplated by one skilled in the art.

Figure 13:
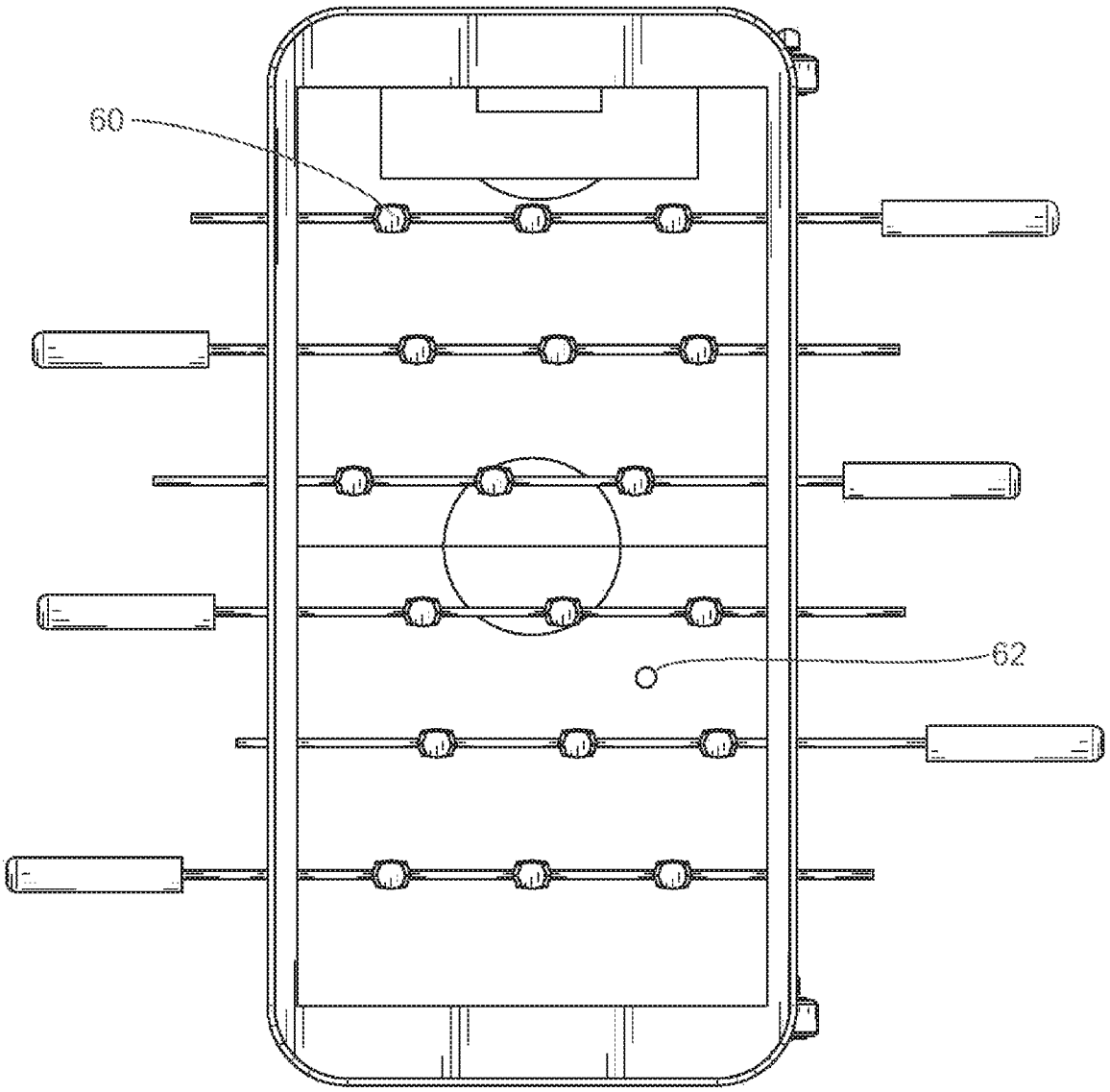
FIG. 13 illustrates top view of a cooler according to an exemplary embodiment of the present invention, including a soccer game configuration.
Figure 14:
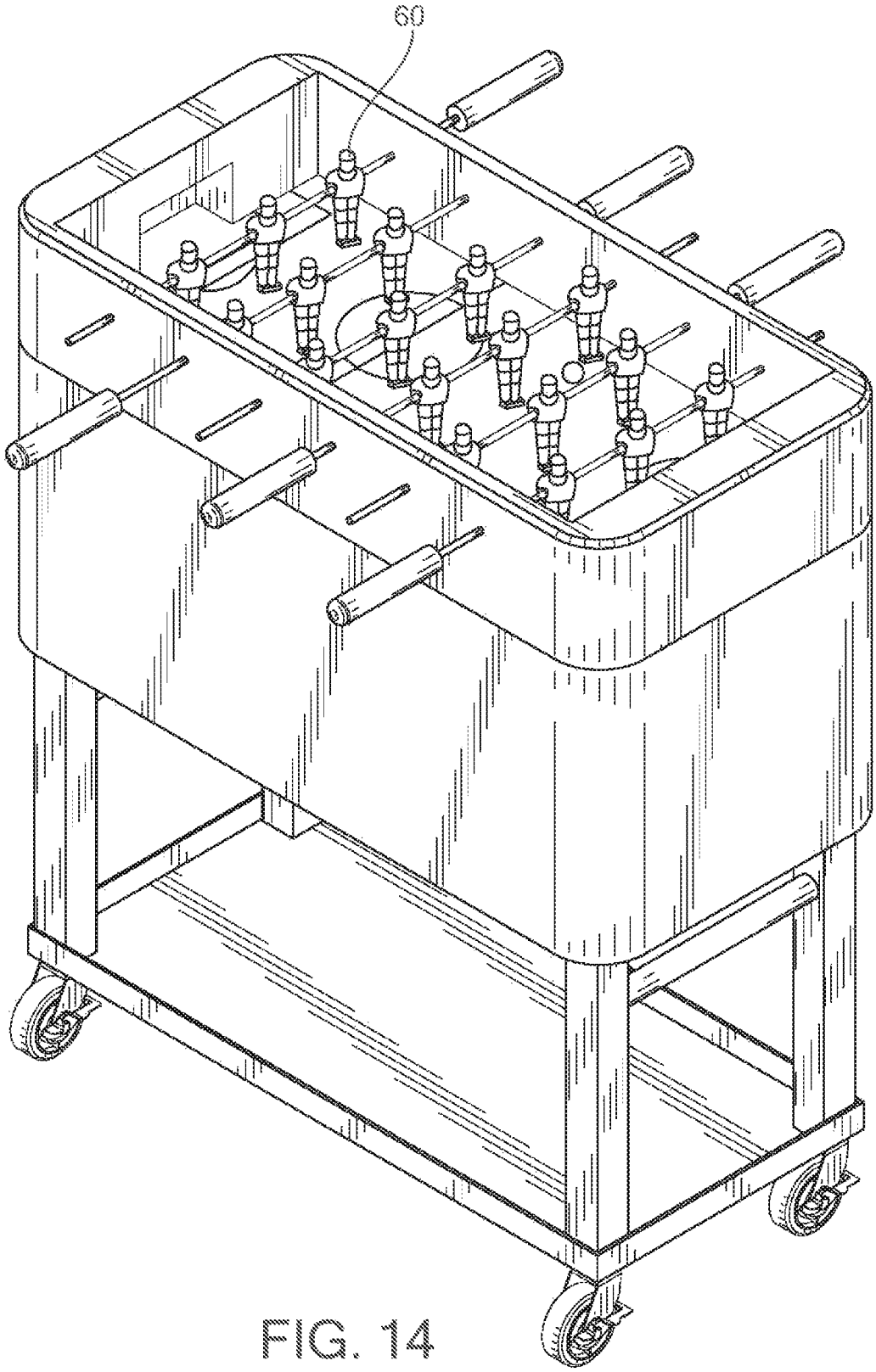
FIG. 14 illustrates perspective view of the cooler of FIG. 13.

Referring to FIGS. 13 and 14, in an embodiment similar to the foosball game, a soccer game may be configured in the game table 34. The soccer game can include soccer players 60 and a soccer ball 62, where the players may move in a manner similar to that described above with respect to the foosball table. In some embodiments, a goalie may be provided. In some embodiments, the user may control the goalie, where in other embodiments, the goalie may automatically slide from side to side of the goal, powered by a mechanical or electronic mechanism, for example, thus adding a level of difficulty in scoring.

In the various player/ball games discussed above, the foosball, soccer ball, hockey puck, or the like, may move along the game surface 36 via action of the players. Goals may be provided at ends as a desired destination for the game balls. In some embodiments, the goals may be recessed into the cooler top 14 to prevent escape of the game balls when a goal is scored.

In some embodiments, the sliding tubes 42 of the foosball or soccer games, or the moving tubes 58 of the hockey game may be removable disposed through the side walls 30, so that the tubes may be stored for transport, for example. Various mechanisms can permit removal of the tubes, while avoiding inadvertent removal during game play. For example, a resiliently movable end may be depressed to shorten the tube for removal, but, during game play, may extend to prevent removal of the tubes.

Figure 15:
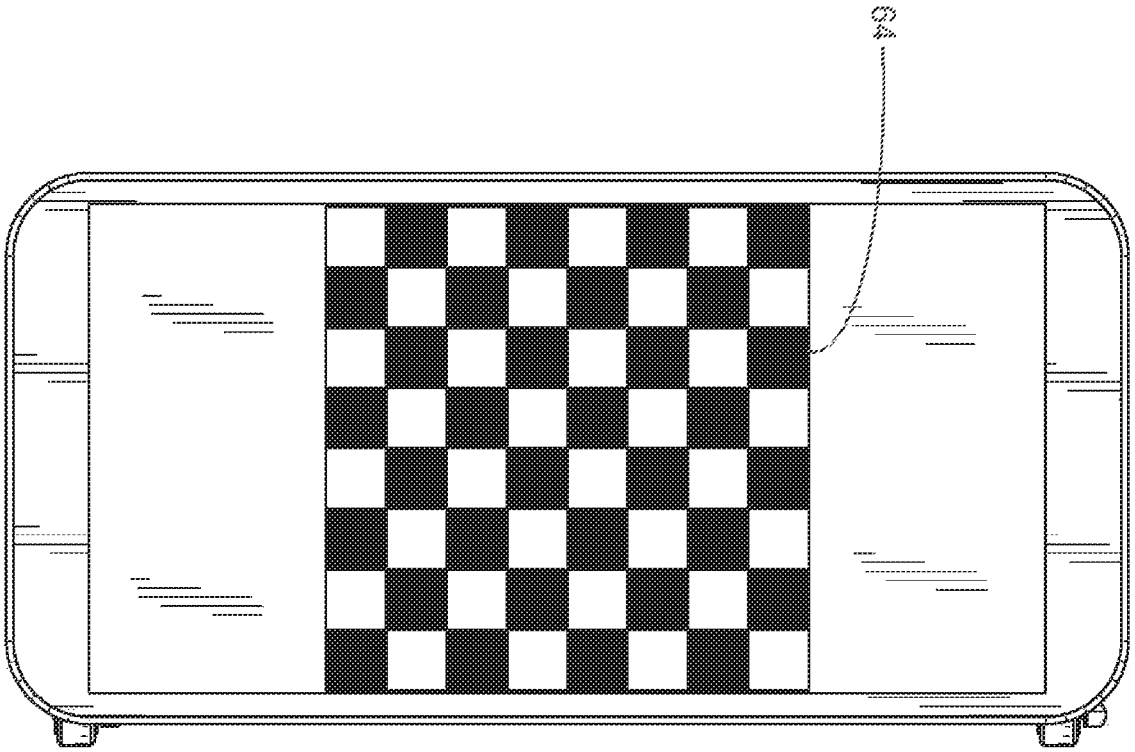
FIG. 15 illustrates top view of a cooler according to an exemplary embodiment of the present invention, including a chess or checkers game configuration.
Figure 16A:
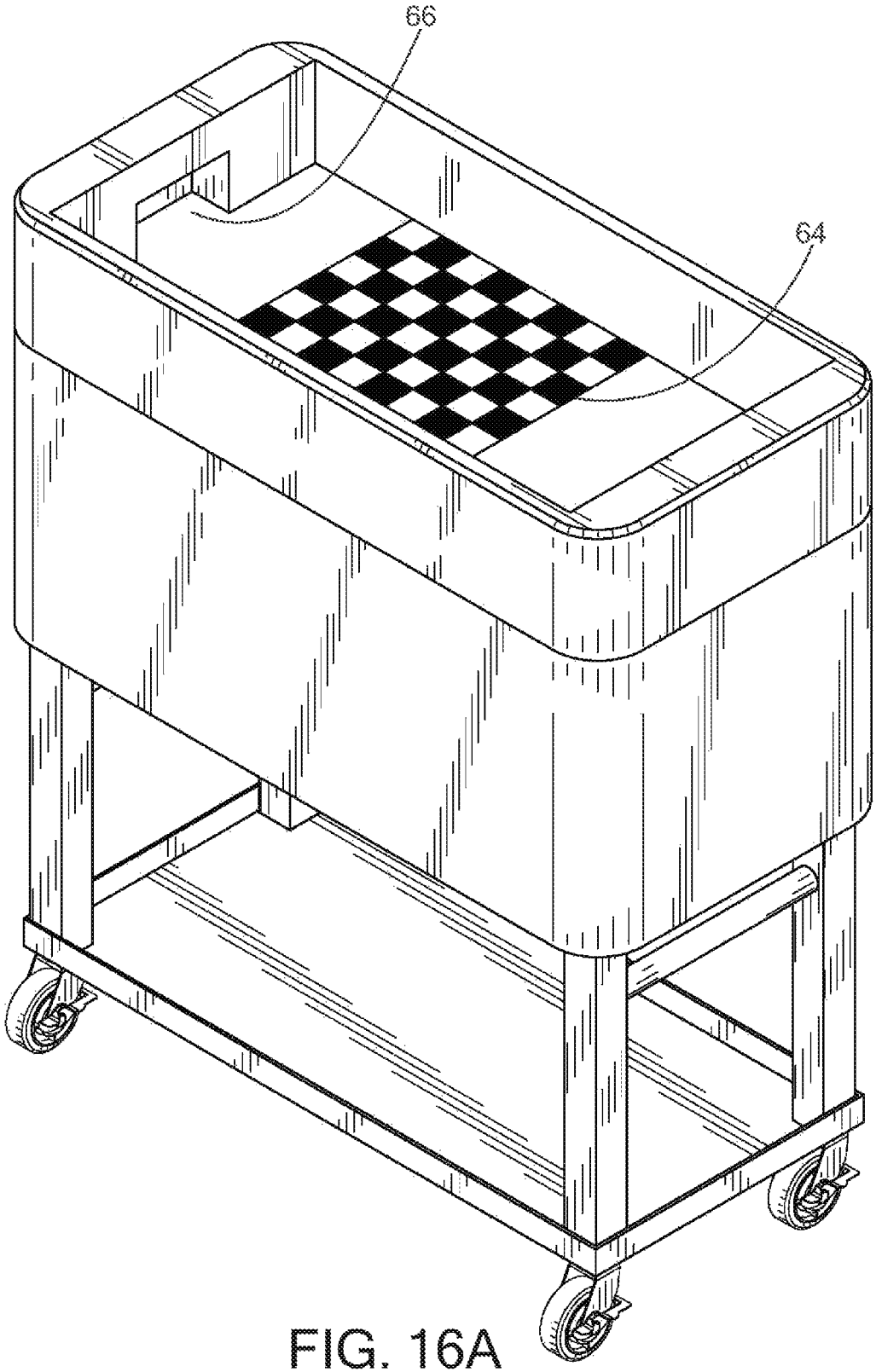
FIG. 16A illustrates perspective view of the cooler of FIG. 15 having an optional game piece storage region.
Figure 16B:
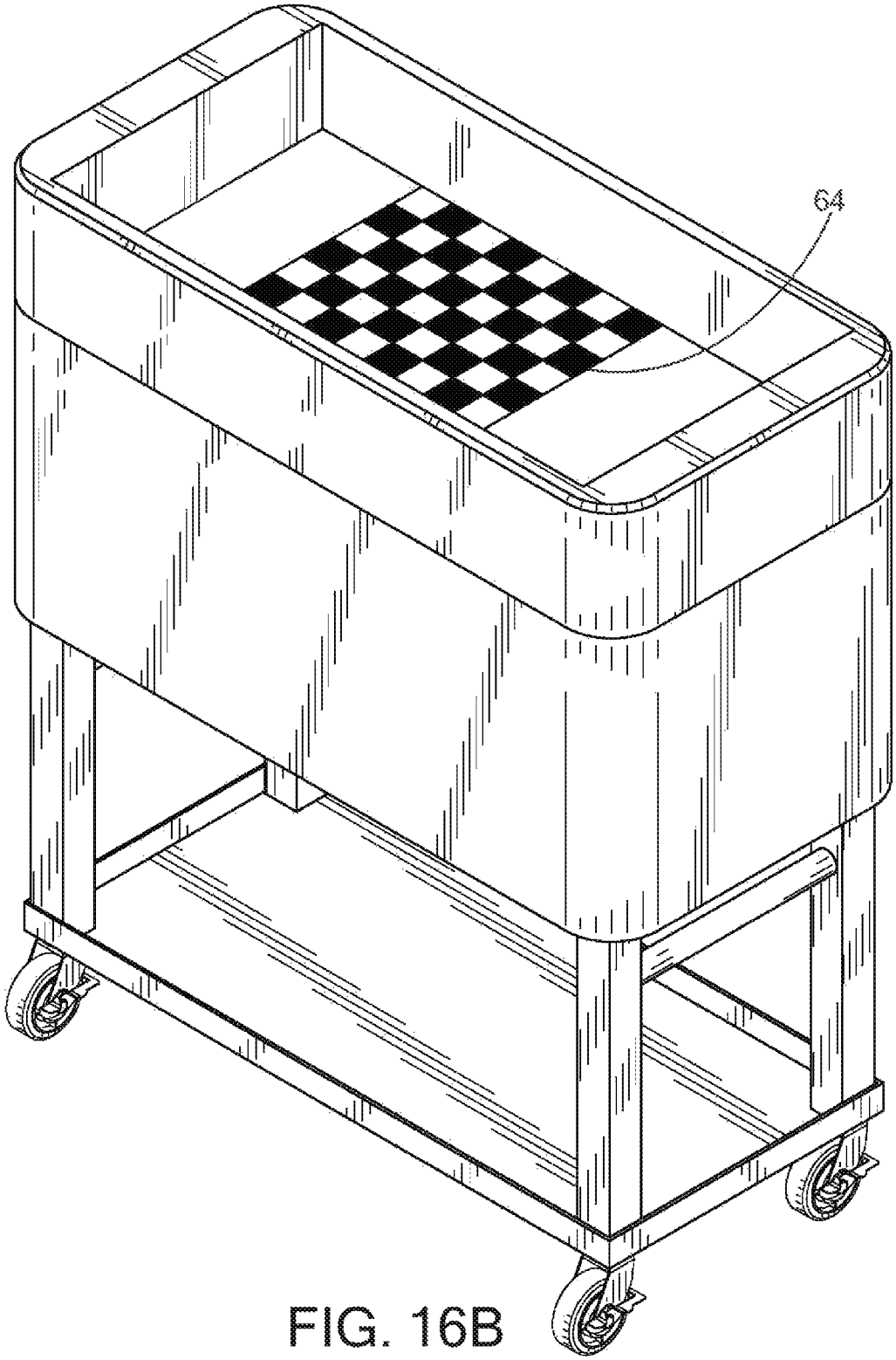
FIG. 16B illustrates a perspective view of the cooler of FIG. 15 without a game piece storage region.
Figure 17:
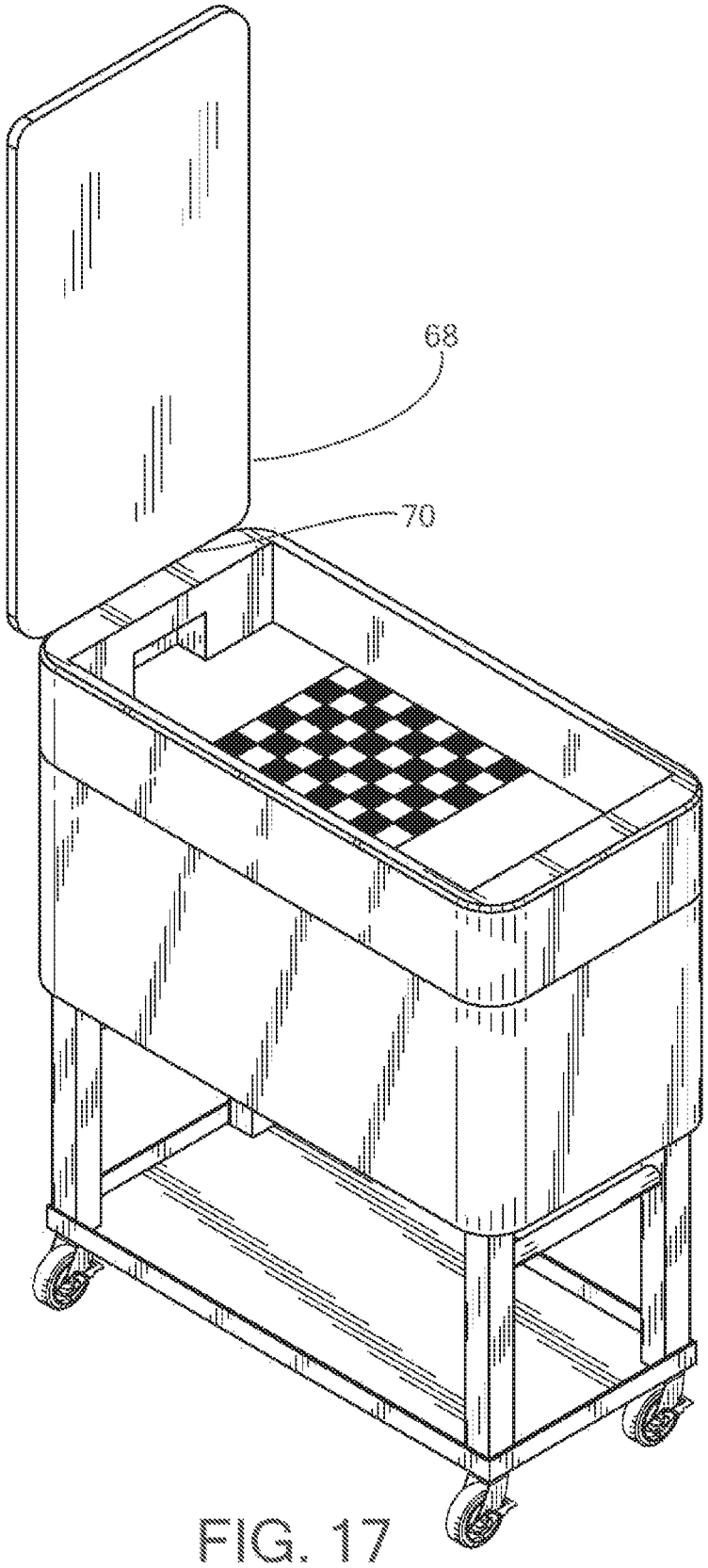
FIG. 17 illustrates a perspective view of the chess or checkers configuration of the cooler of FIG. 15 with an optional lid that may be used with any of the embodiments disclosed herein.
Figure 18:
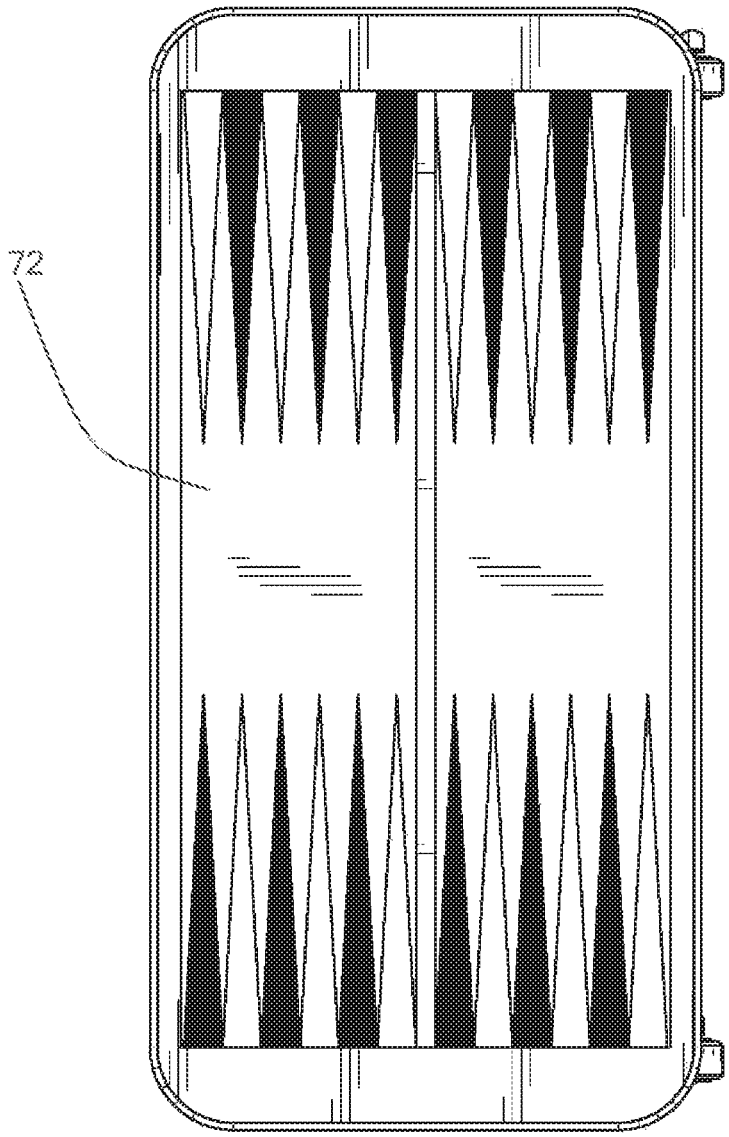
FIG. 18 illustrates top view of a cooler according to an exemplary embodiment of the present invention, including a backgammon game configuration.
Figure 19:
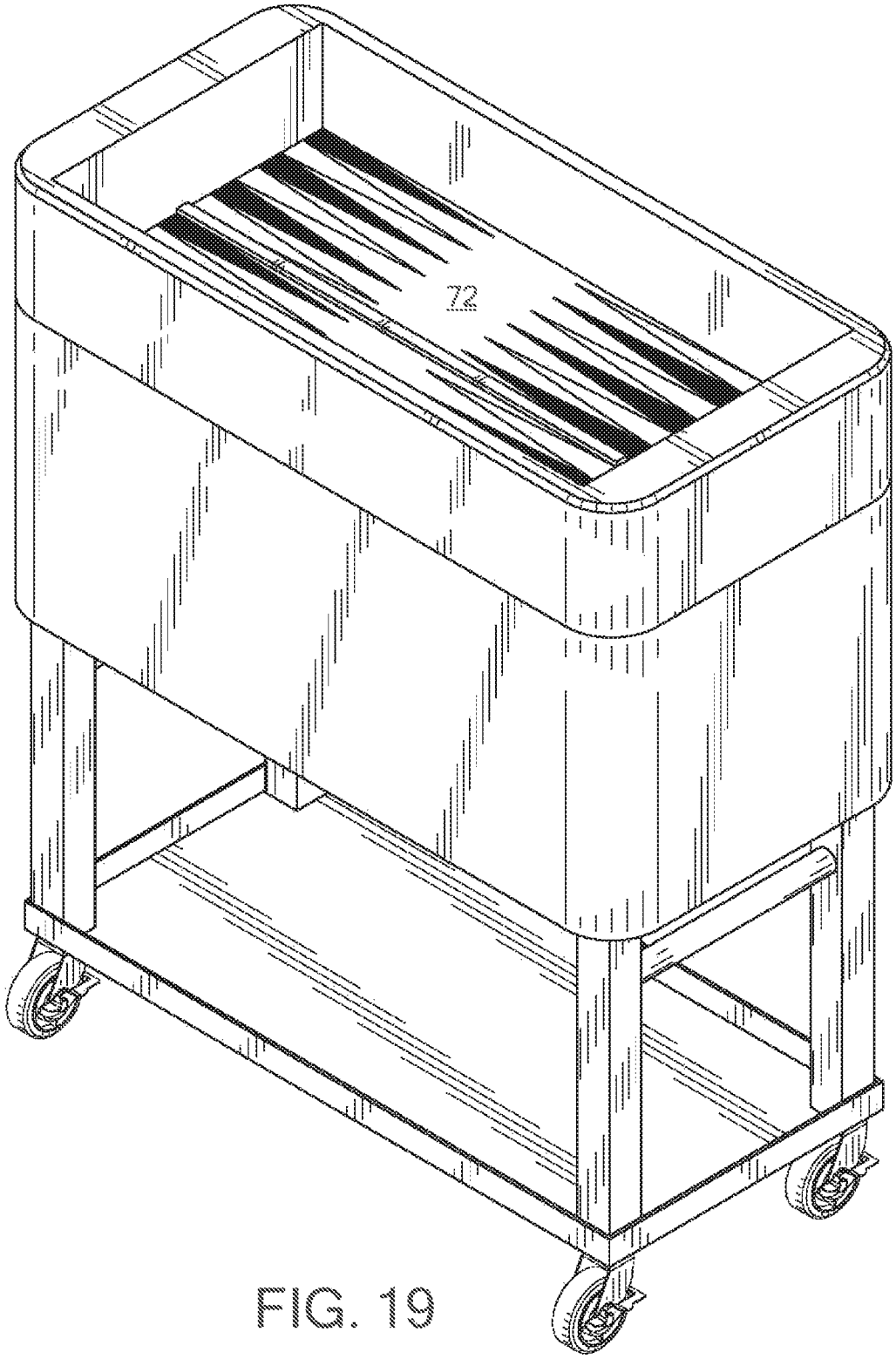
FIG. 19 illustrates perspective view of the cooler of FIG. 18.
Figure 20:
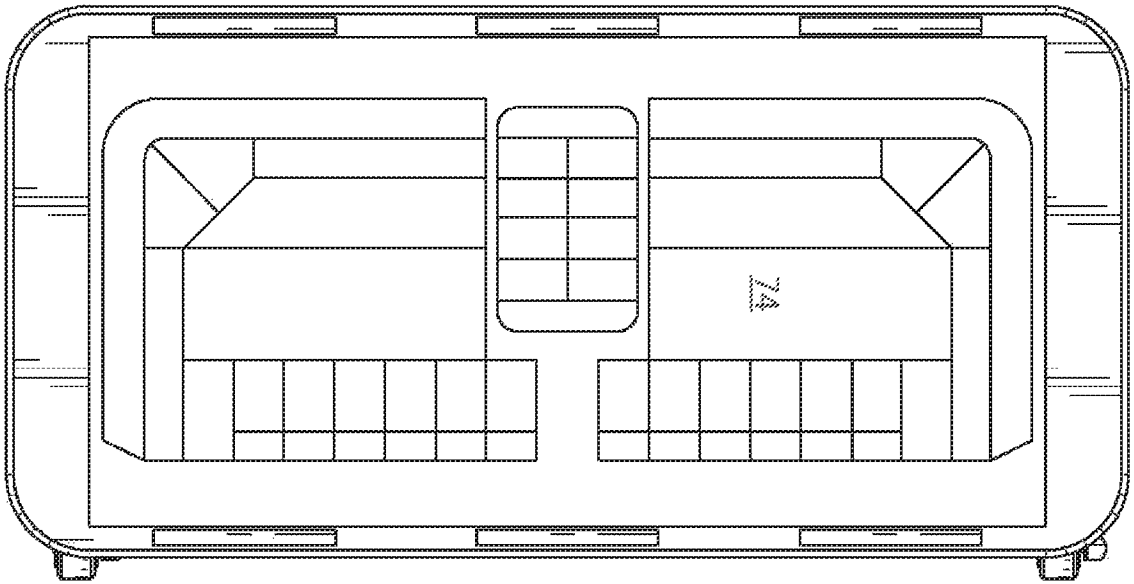
FIG. 20 illustrates top view of a cooler according to an exemplary embodiment of the present invention, including a craps game configuration.
Figure 21:
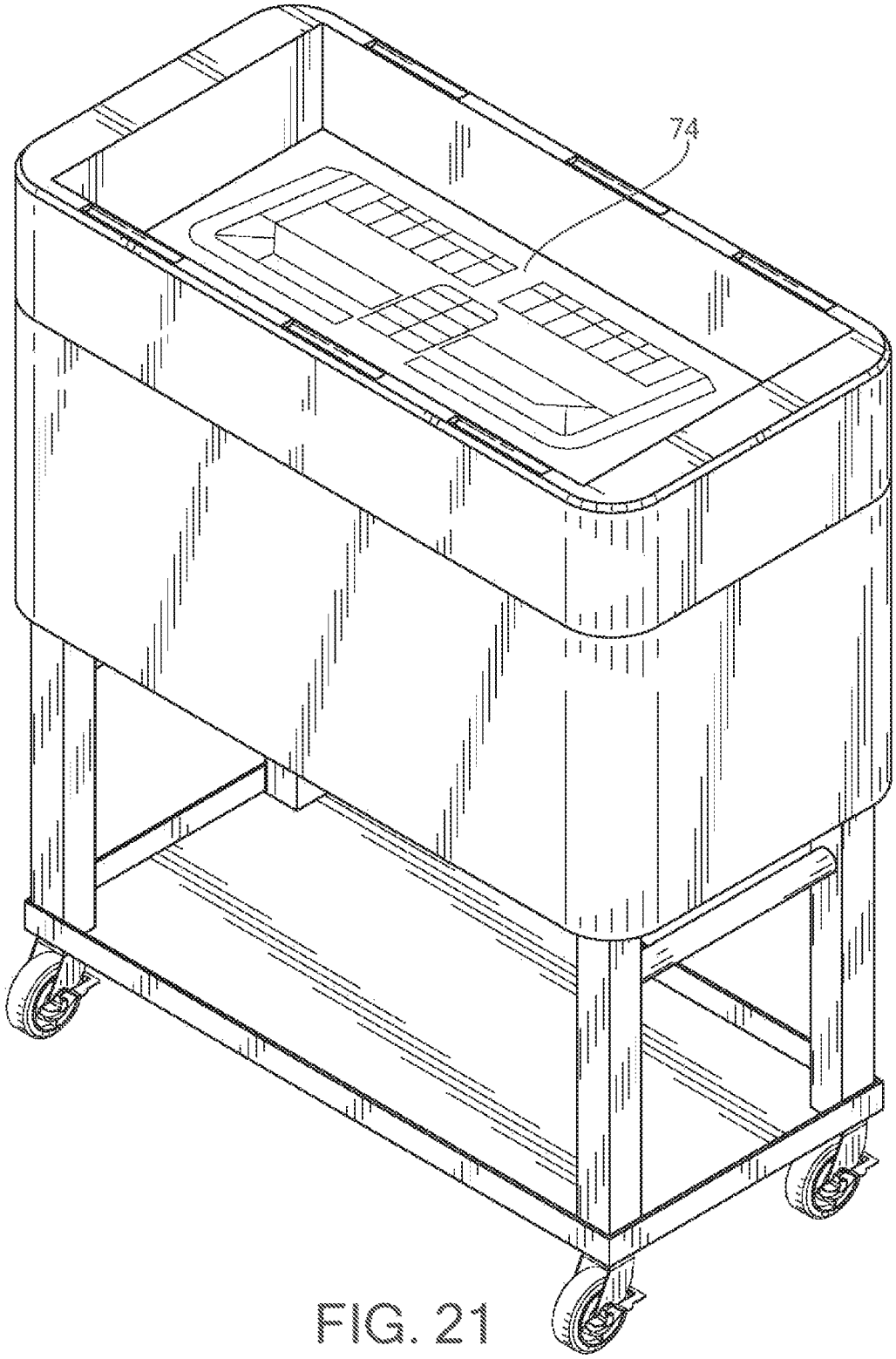
FIG. 21 illustrates perspective view of the cooler of FIG. 20.
Figure 22:
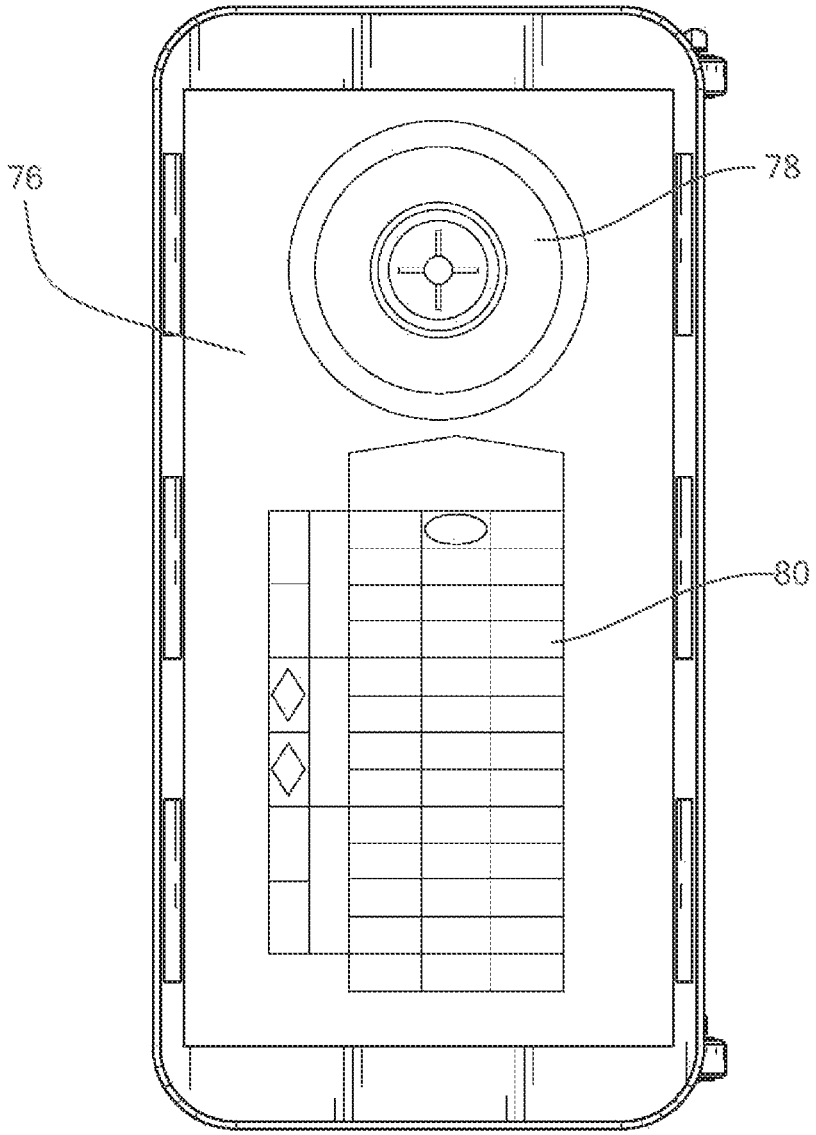
FIG. 22 illustrates top view of a cooler according to an exemplary embodiment of the present invention, including a roulette game configuration.
Figure 23:
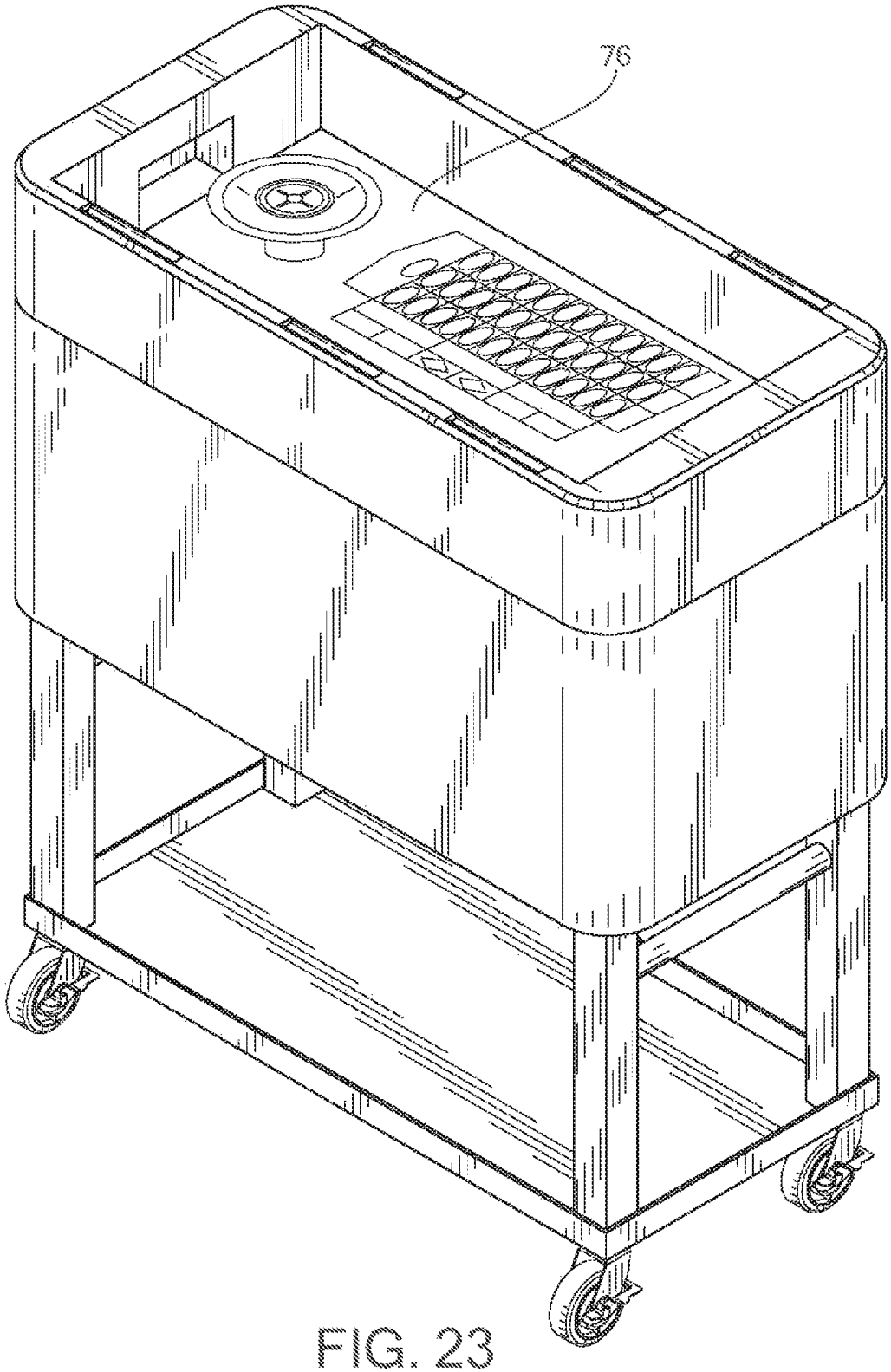
FIG. 23 illustrates perspective view of the cooler of FIG. 22.

Referring to FIGS. 15 through 17, a chess or checker board 64 may be configured in the game table 34. The chess or checker board 64 may employ the standard 8×8 grid pattern, as shown. Of course, other designs may be used, depending on the type of game desired. As shown in FIG. 16A, the goals, as used in the ball games discussed above, may be used as a storage region 66 for storage of the chess or checker pieces (not shown). In some embodiments, the storage region 66 may be absent, as shown in FIG. 16B. In some embodiments, a cover (not shown) may be provided to cover the storage region 66, preventing the pieces from escape therefrom. In some embodiments, the chess or checker board 64 may be formed in the game surface 36, integral with the cooler top 14. In other embodiments, the chess or checker board 64 may be printed on a piece of sheet material that may be placed on the game surface 36.

As shown in FIG. 17, an optional lid 68 may be removable disposed to cover the game table 34. Typically, the lid 68 may be placed on top of ends of the side walls 30 to create a space above the recessed game surface 36. The lid 68 may have a hinge area 70 or may be completely removable from the cooler 10 via various mechanisms, such as pins and holes, snaps, friction fit, and the like. The lid 68 may permit storage of the various game parts, such as the tubes, balls, game pieces, or the like, during transport or storage of the cooler 10.

Other games may be played on the game surface as illustrated in FIGS. 18 through 23. A backgammon surface 72 may be disposed on the game surface 36 or, as discussed above, may be disposed on a sheet that can fit on top of the game surface 36. A craps table design surface 74 may also be similarly disposed on the game surface 36. In another embodiment, a roulette game may be disposed on the game surface 36, including a roulette wheel 48 and a betting area 80. Other games may also be contemplated within the scope of the present invention, including various board games, cribbage games, card games, or the like. In each game, the goals may be included as optional storage regions, or may be removed, as shown in the Figures.

Figure 24:
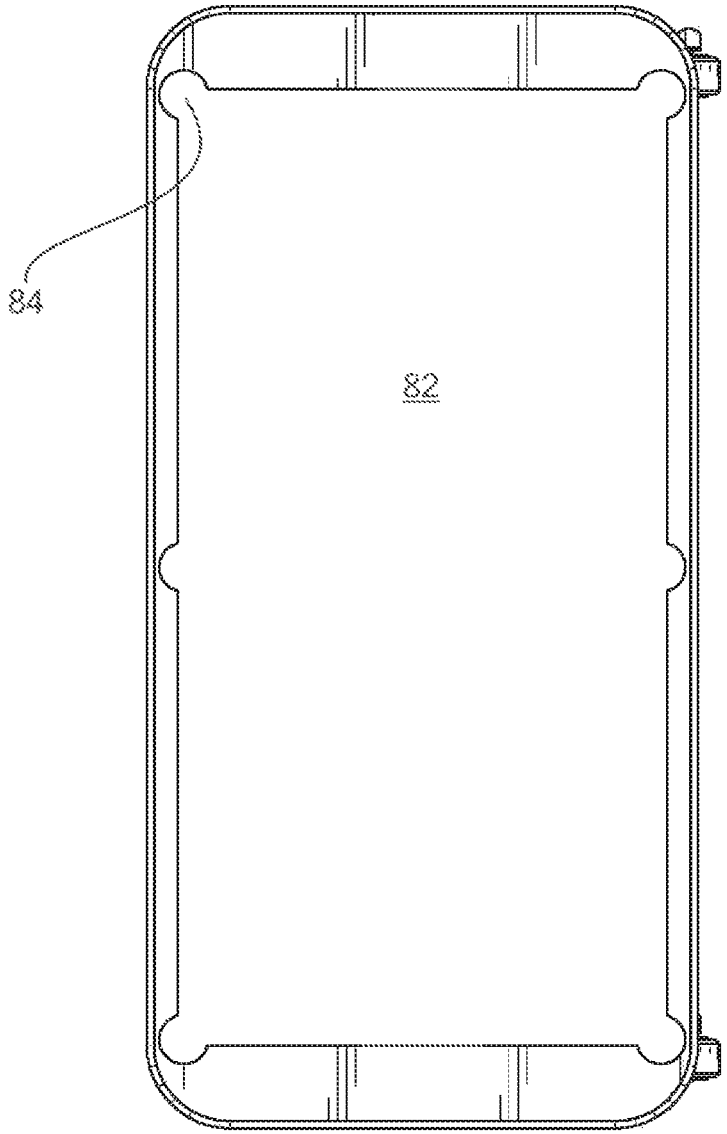
FIG. 24 illustrates top view of a cooler according to an exemplary embodiment of the present invention, including a pool table game configuration.
Figure 25:
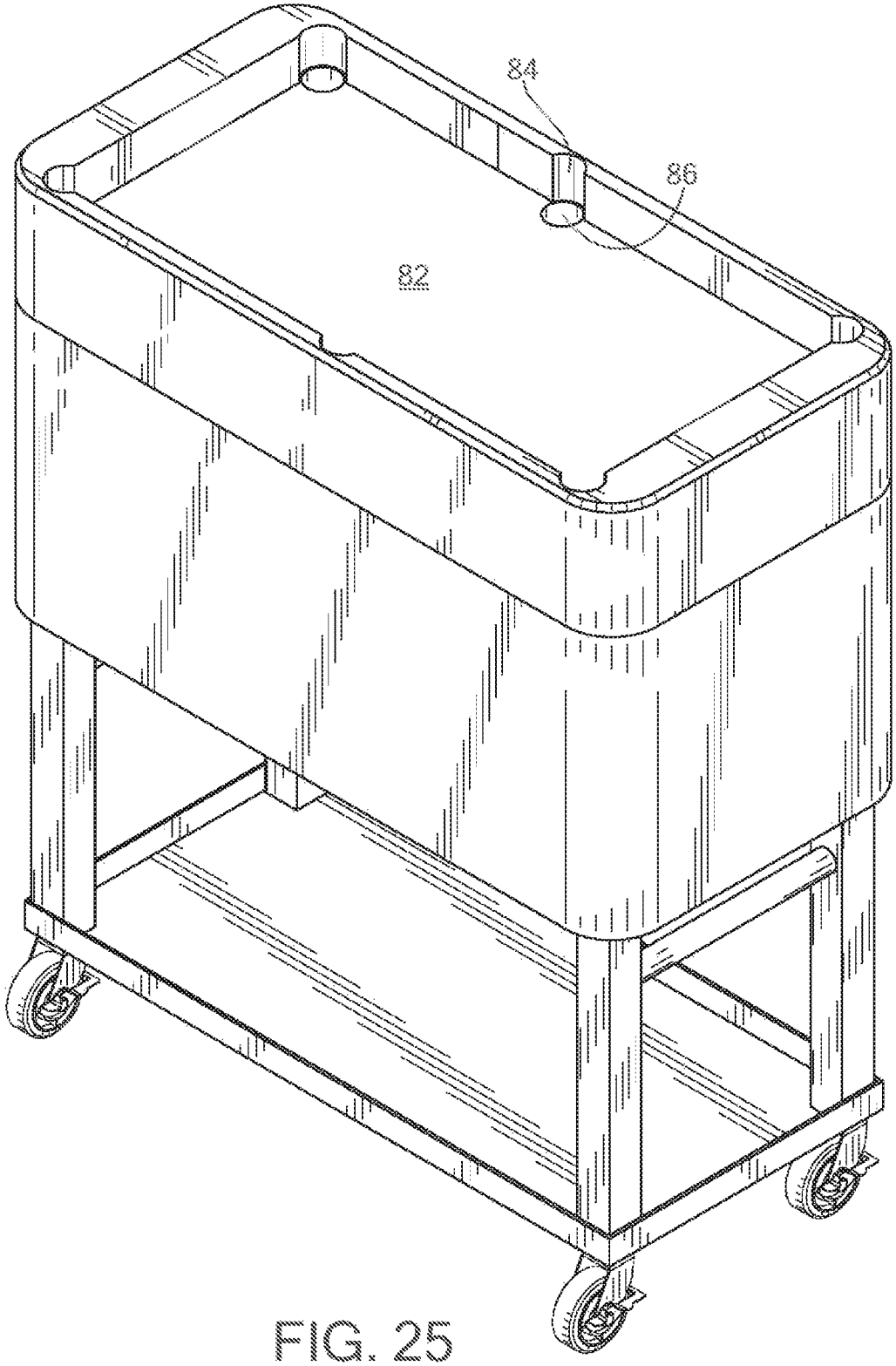
FIG. 25 illustrates perspective view of the cooler of FIG. 24.

Referring now to FIGS. 24 and 25, the cooler top 14 may be configured as in a pool table 82. The pool table 82 can include pockets 84 having a recess 86 to indicate when pool balls (not shown) fall into the pickets 84. Similar to the other embodiments, the recessed game surface 36 may be used as the pool table.

In some embodiments, multiple games may be played on a single device. For example, the pool table configuration may include elements to fill in the pockets of the pool table and tubes with players may be inserted in holes in the side walls to create a foosball game, for example. Likewise, the pool or foosball game configurations may include a board insert to create a chess, checkers, backgammon, or craps configuration.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Claim elements and steps herein may have been numbered and/or lettered solely as an aid in readability and understanding. Any such numbering and lettering in itself is not intended to and should not be taken to indicate the ordering of elements and/or steps in the claims.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a sub combination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. A cooler comprising:

a cooler body;

a cooler top at least partially removable from the cooler body, the cooler top covering the cooler body to create a space therein;

side walls extending upward from an outer perimeter of the cooler top;

a game surface formed on top of the cooler top, the game surface being recessed and surrounded by the side walls; and pool table pockets formed in at least a portion of the side walls, wherein recesses are formed in the cooler top to define a base of the pool table pockets.

2. The cooler of claim 1, further comprising:

a plurality of tubes extending between opposite pairs of side walls; and a plurality of game players, at least one game player disposed on each of the plurality of tubes, the plurality of game players configured to cause an interaction with a game piece disposed on the game surface, wherein the plurality of tubes is movable to move the plurality of game players to cause an interaction with the game piece.

3. The cooler of claim 2, wherein the plurality of tubes is slidable along a longitudinal axis within holes formed in the opposite pairs of side walls.

4. The cooler of claim 2, further comprising handles on ends of the plurality of tubes, a first quantity of the handles on one side of a first portion of the plurality of tubes and a second quantity of the handles on another side of a second portion of the plurality of tubes.

5. The cooler of claim 4, wherein rotation of the handles causes respective ones of the plurality of game players to rotate about a longitudinal axis of respective one of the plurality of tubes.

6. The cooler of claim 2, wherein the game players are foosball or soccer players.

7. The cooler of claim 2, wherein the game players are hockey players.

8. The cooler of claim 7, wherein the hockey players include hockey sticks, and rotation of respective ones of the plurality of tubes cause rotation of the hockey players about a longitudinal axis of the hockey players.

9. The cooler of claim 1, wherein the game surface is a board game surface.

10. The cooler of claim 9, wherein the board game surface is selected from the group consisting of a chess game, a checkers game and a backgammon game.

11. The cooler of claim 1, wherein the game surface is a gambling game surface.

12. The cooler of claim 11, wherein the gambling game surface is selected from a craps table surface and a roulette table surface.

13. The cooler of claim 1, further comprising a removable lid disposable over ends of the side walls, forming a space above the game surface.

14. A cooler comprising:

a cooler body;

a cooler top at least partially removable from the cooler body, the cooler top covering the cooler body to create a space therein;

side walls extending upward from an outer perimeter of the cooler top;

a game surface formed on top of the cooler top, the game surface being recessed and surrounded by the side walls;

a plurality of tubes extending between opposite pairs of side walls; and a plurality of game players, at least one game player disposed on each of the plurality of tubes, the plurality of game players configured to cause an interaction with a game piece disposed on the game surface, wherein the plurality of tubes is movable to move the plurality of game players in a first direction, and the plurality of tubes are further movable to move the plurality of game players in a second direction, at least one of the first and second directions causing an interaction with the game piece.

15. The cooler of claim 14, further comprising handles on ends of the plurality of tubes, a first quantity of the handles on one side of a first portion of the plurality of tubes and a second quantity of the handles on another side of a second portion of the plurality of tubes.

16. The cooler of claim 14, further comprising at least one goal formed as an inset on an interior surface of at least one of the side walls.

17. A cooler comprising:

a cooler body;

a cooler top at least partially removable from the cooler body, the cooler top covering the cooler body to create a space therein;

side walls extending upward from an outer perimeter of the cooler top; and a game surface formed on top of the cooler top, the game surface being recessed and surrounded by the side walls; and pool table pockets formed in at least a portion of the side walls, wherein recesses are formed in the cooler top to define a base of the pool table pockets, wherein the game surface is a pool table surface.

* * * * *